US009662761B2

(12) United States Patent
Shinozaki et al.

(10) Patent No.: US 9,662,761 B2
(45) Date of Patent: May 30, 2017

(54) POLISHING APPARATUS

(71) Applicant: Ebara Corporation, Tokyo (JP)

(72) Inventors: Hiroyuki Shinozaki, Tokyo (JP); Nobuyuki Takahashi, Tokyo (JP); Toru Maruyama, Tokyo (JP); Suguru Sakugawa, Tokyo (JP); Osamu Nabeya, Tokyo (JP)

(73) Assignee: Ebara Corporation, Tokyo (JP)

( * ) Notice: Subject to any disclaimer, the term of this patent is extended or adjusted under 35 U.S.C. 154(b) by 158 days.

(21) Appl. No.: 14/553,389

(22) Filed: Nov. 25, 2014

(65) Prior Publication Data

US 2015/0151401 A1 Jun. 4, 2015

(30) Foreign Application Priority Data

Dec. 2, 2013 (JP) ..... 2013-248945
Jan. 10, 2014 (JP) ..... 2014-003237

(51) Int. Cl.

| | |
|---|---|
| ***B24B 37/04*** | (2012.01) |
| ***B24B 37/005*** | (2012.01) |
| ***B24B 37/32*** | (2012.01) |
| ***B24B 49/08*** | (2006.01) |

(52) U.S. Cl.

CPC ..... *B24B 37/04* (2013.01); *B24B 37/005* (2013.01); *B24B 37/32* (2013.01); *B24B 49/08* (2013.01)

(58) Field of Classification Search

CPC ..... B24B 37/00–37/345; B24B 49/08
See application file for complete search history.

(56) References Cited

U.S. PATENT DOCUMENTS 5,916,015 A * 6/1999 Natalicio ..... B24B 37/0053 451/288
6,180,423 B1 1/2001 Hashimoto et al.
6,666,756 B1 * 12/2003 Travis ..... B24B 49/16 451/283

(Continued)

FOREIGN PATENT DOCUMENTS

JP 11-070468 3/1999
JP 2001-105298 4/2001

(Continued)

*Primary Examiner* — Larry E Waggle, Jr.
*Assistant Examiner* — Henry Hong
(74) *Attorney, Agent, or Firm* — Leydig, Voit & Mayer, Ltd.

(57) ABSTRACT

A polishing apparatus capable of stably controlling a pressure in a pressure chamber of a top ring is disclosed. The polishing apparatus includes: a rotatable polishing table for supporting a polishing pad; a rotatable top ring having a pressure chamber for pressing a substrate against the polishing pad; a pressure regulator configured to regulate a pressure of a gas in the pressure chamber; and a buffer tank provided between the pressure chamber and the pressure regulator. The pressure regulator includes a pressure-regulating valve, a pressure gauge configured to measure the pressure of the gas at a downstream side of the pressure-regulating valve, and a valve controller configured to control an operation of the pressure-regulating valve so as to minimize a difference between a target value of the pressure in the pressure chamber and a pressure value measured by the pressure gauge.

24 Claims, 30 Drawing Sheets

(56) References Cited

U.S. PATENT DOCUMENTS

| | | | | |
|---|---|---|---|---|
| 2001/0034198 | A1* | 10/2001 | Kimura | B24B 37/32 451/285 |
| 2004/0209560 | A1* | 10/2004 | Togawa | B24B 37/32 451/288 |
| 2005/0054266 | A1* | 3/2005 | Togawa | B24B 49/16 451/5 |
| 2009/0305612 | A1* | 12/2009 | Miyazaki | B24B 37/345 451/11 |
| 2010/0311309 | A1* | 12/2010 | Shinozaki | B24B 49/08 451/5 |
| 2011/0159783 | A1* | 6/2011 | Fukushima | B24B 37/042 451/11 |
| 2014/0087629 | A1 | 3/2014 | Takahashi et al. | |

FOREIGN PATENT DOCUMENTS

| | | |
|---|---|---|
| JP | 2005-081507 | 3/2005 |
| JP | 2007-507079 | 3/2007 |
| JP | 2010-050436 | 3/2010 |

* cited by examiner

POLISHING APPARATUS

CROSS REFERENCE TO RELATED APPLICATIONS

This document claims priorities to Japanese Patent Application Number 2013-248945 filed Dec. 2, 2013 and Japanese Patent Application Number 2014-003237 filed Jan. 10, 2014, the entire contents of which are hereby incorporated by reference.

BACKGROUND

A CMP (Chemical Mechanical Polishing) apparatus is a machine for polishing a surface of a substrate, such as a wafer, by pressing the substrate against a polishing pad while supplying a polishing liquid onto the polishing pad. The CMP apparatus is widely known as a polishing apparatus for manufacturing a semiconductor device.

FIG. 1 is a schematic view showing a polishing apparatus for polishing a wafer. As shown in FIG. 1, the polishing apparatus includes a polishing table 2 for supporting a polishing pad 1, and a top ring (or a substrate holder) 5 for pressing a wafer W against the polishing pad 1. The polishing table 2 is coupled via a table shaft 2*a* to a table motor 3 which is located below the polishing table 2, so that the polishing table 2 is rotated by the table motor 3 in a direction indicated by arrow. The polishing pad 1 is attached to an upper surface of the polishing table 2. The polishing pad 1 has an upper surface 1*a* that serves as a polishing surface for polishing the wafer W. The top ring 5 is secured to a lower end of a top ring shaft 6. The top ring 5 is configured to hold the wafer W on its lower surface by vacuum suction.

Polishing of the wafer W is performed as follows. The top ring 5 and the polishing table 2 are rotated in the same direction as indicated by arrows, while a polishing liquid (or slurry) is supplied from a polishing liquid supply nozzle 7 onto the polishing pad 1 that is being rotated together with the polishing table 2. In this state, the top ring 5, holding the wafer W on its lower surface, is lowered to a predetermined position (i.e., a predetermined height), at which the top ring 5 presses the wafer W against the polishing surface 1*a* of the polishing pad 1. A surface of the wafer W is polished by a mechanical action of abrasive grains contained in the polishing liquid and a chemical action of the polishing liquid.

FIG. 2 is a schematic view showing a structure of the top ring 5. The top ring 5 includes a plurality of pressure chambers 10 for pressing the wafer W against the polishing pad 1. These pressure chambers 10 are formed by an elastic membrane (or a membrane) 11. A gas, such as an air or a nitrogen gas, is supplied to the pressure chambers 10 separately via a plurality of pressure regulators 15 and a rotary joint 14. Pressures of the gas in the pressure chambers 10 are regulated by the pressure regulators 15. The top ring 5 having such multiple pressure chambers 10 can press multiple zones of the wafer W against the polishing pad 1 at desired pressures.

According to Preston's law, a polishing rate (which is also referred to as a removal rate) of the wafer W is expressed by $$RR \propto P \cdot V$$

where RR represents the polishing rate, P represents a surface pressure exerted on the wafer W when pressed against the polishing pad 1, and V represents a relative speed between the wafer surface and the surface of the polishing pad.

In order to uniformly polish the wafer W, it is preferable that the relative speed V be uniform in the wafer surface. A condition for realizing the uniform relative speed V is that a rotational speed of the polishing table 2 (i.e., a rotational speed of the polishing pad 1) is equal to a rotational speed of the top ring 5 (i.e., a rotational speed of the wafer W).

However, when the wafer W is polished while the polishing table 2 and the top ring 5 are rotated at the same rotational speed, concentric patterns appear on a polished surface of the wafer W. Such appearance of the concentric patterns indicates that the polished surface of the wafer W is not planar. A known solution for preventing such appearance of the patterns is to rotate the polishing table 2 and the top ring 5 at slightly different rotational speeds.

As a demand for a film-thickness uniformity of a wafer has been increasing in recent years, a stability of the pressure in each pressure chamber 10 during polishing of the wafer is becoming more important. In particular, fluctuation of the pressure in the pressure chamber 10 and fluctuation of flow rate of the gas flowing into the pressure chamber 10 are thought to be impediments to the film-thickness uniformity of the wafer.

The surface of the polishing pad 1 is not completely flat. In addition, the top ring 5 may vibrate periodically with the rotation itself. As a result, during polishing of the wafer, a volume of each pressure chamber 10, i.e., the pressure in each pressure chamber 10, may slightly fluctuate with the rotations of the polishing table 2 and the top ring 5. The pressure regulator 15 is operable to cancel the fluctuation of the pressure in the pressure chamber 10 so that the pressure in the pressure chamber 10 is maintained at a predetermined target value. Therefore, a responsiveness of the pressure regulator 15 is important for achieving good polishing results.

FIG. 3 is a schematic view of the pressure regulator 15. The pressure regulator 15 includes a pressure-regulating valve 16 for regulating pressure of the gas in the pressure chamber 10, a pressure gauge 17 for measuring pressure of the gas at a downstream side of the pressure-regulating valve 16 (i.e., outlet pressure or secondary pressure), and a valve controller (for example, a PID controller) 21 for generating a valve control signal for minimizing a difference between a measured value Pact of the pressure and a target value Pc of the pressure. The outlet pressure corresponds to the pressure in the pressure chamber 10. The pressure-regulating valve 16 regulates the outlet pressure according to the valve control signal. An electropneumatic regulator is widely used as the pressure regulator 15.

FIG. 4 is a graph showing a relationship between time and the target value Pc inputted into the pressure regulator 15. As shown in FIG. 4, typically, the target value Pc of the pressure in the pressure chamber 10 is inputted to the valve controller 21 of the pressure regulator 15 at a certain time t0, and is then kept constant. FIG. 5 is a graph showing the actual pressure Pact measured by the pressure gauge 17. As shown in FIG. 5, the pressure Pact reaches the target value Pc after a delay of Δt from the input time t0 of the target value Pc. The pressure Pact after it has reached the target value Pc fluctuates with a certain range ΔP.

From a viewpoint of the responsiveness of the pressure regulator 15, it is desirable that the time difference Δt be as small as possible. In addition, from a viewpoint of the stability of the pressure in the pressure chamber 10, it is desirable that the fluctuation range ΔP be as small as possible. It is possible to improve the responsiveness of the pressure regulator 15 (i.e., to reduce the time difference Δt) by changing an operation setting of the valve controller 21.

However, the improvement of the responsiveness may cause, as shown in FIG. 6, an overshoot of the pressure Pact when the target value Pc is inputted, resulting in unstable pressure Pact. On the other hand, in order to prevent the overshoot so as to stabilize the pressure Pact, it is necessary to increase a response time of the pressure regulator 15. However, this means, as shown in FIG. 7, an increase in the time difference Δt.

It is required for the valve controller 21 to improve the response to the input of the target value Pc, eliminate the overshoot, and stabilize the actual pressure Pact corresponding to the constant target value Pc. FIG. 8 is a graph showing a frequency response characteristic of the valve controller 21. A vertical axis in FIG. 8 represents amplification factor which is a ratio of the actual pressure (actually measured value) Pact to the target value Pc. The amplification factor is expressed with use of decibel [dB] as unit. Specifically, in a case where the ratio of the actual pressure Pact to the target value Pc (Pact/Pc) is 1, i.e., in a case where the actual pressure Pact is equal to the target value Pc, the amplification factor is 0 dB. Generally, an ideal amplification factor is 0 dB. The graph in FIG. 8 shows the frequency response characteristic for realizing the responsiveness shown in FIG. 5.

A horizontal axis in FIG. 8 represents frequency of an input control signal inputted into the valve controller 21. The input control signal includes not only the pressure target value Pc, but also the difference between the pressure target value Pc and the pressure value Pact which is a feedback value. The pressure target value Pc is constant as shown in FIG. 4, while the pressure value Pact slightly fluctuates periodically with the rotations of the polishing table 2 and the top ring 5. As a result, the input control signal also fluctuates. The frequency of the input control signal corresponds to an oscillation frequency of the pressure value Pact, and this oscillation frequency of the pressure value Pact corresponds to a frequency calculated from the rotational speeds of the polishing table 2 and the top ring 5. The horizontal axis in FIG. 8 represents this frequency of the fluctuating input control signal (i.e., the frequency of the measured pressure value Pact). A term "fc" shown in FIG. 8 is a resonance frequency.

Generally, during polishing of the wafer, the polishing table 2 and top ring 5 are independently rotated within a speed range of 60 $min^{-1}$ to 120 $min^{-1}$. As described above, the surface of the polishing pad 1 is not completely planar, and the top ring 5 may periodically vibrate with the rotation itself. Accordingly, during polishing of the wafer, the volume of the pressure chambers 10 slightly fluctuates with the rotations of the polishing table 2 and the top ring 5. Therefore, a volume Q of a gas storage space including the pressure chambers 10, i.e., a total of the volume of the pressure chambers 10 and a volume of gas passages 28 from the pressure regulators 15 to the pressure chambers 10, fluctuates.

Such fluctuation of the volume Q of the gas storage space affects the pressure value Pact indicating the outlet pressure of the pressure regulator 15, and as a result the input control signal fluctuates at frequency in synchronization with the rotational speeds of the polishing table 2 and top ring 5. For example, when the polishing table 2 and top ring 5 are rotated at the same rotational speed of 60 $min^{-1}$, the input control signal oscillates at 1 Hz (60 $min^{-1}$/60 sec=1 Hz). When the polishing table 2 and the top ring 5 are rotated at the same rotational speed of 120 $min^{-1}$, the input control signal oscillates at 2 Hz (120 $min^{-1}$/60 sec=2 Hz).

However, as can be seen from the graph in FIG. 8, the amplification factor is not 0 dB (a rate of 1) when the frequency of the input control signal is in a range of 1 to 2 Hz. This indicates that the pressure Pact divergently oscillates when the polishing table 2 and the top ring 5 are rotated at the rotational speed within the speed range of 60 $min^{-1}$ to 120 $min^{-1}$.

One of solutions for preventing the divergent oscillation of the pressure Pact is to rotate the polishing table 2 and the top ring 5 at different rotational speeds. When the polishing table 2 and the top ring 5 are rotated at different rotational speeds, the volume Q of the gas storage space (i.e., the pressure chambers 10 and the gas passages 28) fluctuates while greatly undulating with time, as shown in FIG. 9. In FIG. 9, a period T1 of the undulation of the volume Q corresponds to a period that is converted from a difference (which is an absolute value) between the rotational speed of the polishing table 2 and the rotational speed of the top ring 5. A period T2 of the oscillation of the volume Q corresponds to a period that is converted from the rotational speed of the polishing table 2.

As can be seen from FIG. 9, a fluctuation range ΔQ of the volume Q periodically approaches zero. Therefore, the pressure Pact does not divergently oscillate despite the amplification factor of more than 0 dB. As a result, the pressure Pact is maintained at a value close to the target value Pc while the pressure Pact is fluctuating slightly. However, as described above, in order to polish a wafer uniformly, it is desirable to rotate the polishing table 2 and the top ring 5 at the same rotational speed.

Recently, the pressure regulator 15 is typically disposed near the top ring 5, from viewpoints of the responsiveness of the pressure regulator 15 (for reducing the time difference Δt) and an accessibility when exchanging the pressure regulator 15. Accordingly, the volume Q of the gas storage space (the pressure chambers 10 and the gas passages 28) tends to be small. As the volume Q becomes smaller, the fluctuation range ΔQ of the volume Q becomes relatively large. As a result, the volume fluctuation of the pressure chambers 10 greatly affects the pressure Pact.

Further, in a polishing apparatus including multiple sets of polishing tables and top rings, lengths of gas passages may be different between the top rings. Such a difference in the lengths of the gas passages may result in a difference in magnitude of the fluctuation of the pressure Pact between the top rings. As a result, a wafer polishing result may vary between the top rings.

As shown in FIG. 2, the top ring 5 has, at its lower portion, the pressure chambers 10 formed by the elastic membrane (or membrane) 11. The pressurized gas is supplied into these pressure chambers 10. A polishing pressure on the wafer W when pressed against the polishing pad 1 is controlled by the pressures in the pressure chambers 10. The pressures in the pressure chambers 10 are regulated by the pressure regulators 15.

The top ring 5 having the pressure chambers 10 can apply uniform pressure to the wafer in its entirety, as compared with other type of top ring which is designed to press a wafer with a rigid element. Therefore, uniform and stable polishing characteristics can be obtained. However, with a trend toward a high density of devices, the polishing apparatus is increasingly required to have a more improved polishing performance. In particular, there is a strong demand for stabilizing the gas pressures in the pressure chambers 10 during polishing of the wafer.

As shown in FIG. 2, since the polishing table 2 and the top ring 5 are rotated during polishing of the wafer, a relative position in a vertical direction between the polishing table 2 and the top ring 5 is slightly varied with the rotations thereof. Since the interior volumes of the pressure chambers 10 fluctuate with the variation in this relative position, the pressures in the pressure chambers 10 also fluctuate.

Typically, the rotational speeds of the polishing table 2 and the top ring 5 are about 50 to 100 revolutions per minute. Further, the polishing table 2 and the top ring 5 are rotated at different rotational speeds. The reason for this is to prevent the wafer, held by the top ring 5, from sweeping across the same portion of the polishing pad 1 to thereby prevent polishing patterns from occurring on a polished surface of the wafer. In this manner, since there exists a difference in the rotational speed between the polishing table 2 and the top ring 5, the magnitude of the fluctuation of the interior volumes of the pressure chambers 10 also fluctuates.

The interior volumes of the pressure chambers 10 fluctuate with a period corresponding to the rotational speeds of the polishing table 2 and the top ring 5. However, it is difficult for the pressure regulators 15 to follow such instantaneous pressure fluctuation that continuously varies in its magnitude.

SUMMARY OF THE INVENTION

According to an embodiment, there is provided a polishing apparatus capable of stably controlling a pressure in a pressure chamber of a top ring.

Further, there is provided a polishing apparatus capable of reducing fluctuation of a pressure in a pressure chamber of a top ring (or a substrate holder) to thereby stabilize the pressure in the pressure chamber.

Embodiments, which will be described below, relate to a polishing apparatus for polishing a surface of a substrate, such as a wafer, by pressing the substrate against a polishing pad, and more particularly to a polishing apparatus that presses the substrate against the polishing pad by a pressure chamber in which a pressurized gas has been supplied.

Embodiments, which will be described below, further relate to a polishing apparatus for polishing a substrate, such as a wafer, and more particularly to a polishing apparatus including a pressure regulator for regulating a pressure in a pressure chamber for pressing the substrate against a polishing pad.

In an embodiment, there is provided a polishing apparatus comprising: a rotatable polishing table for supporting a polishing pad; a rotatable top ring having a pressure chamber for pressing a substrate against the polishing pad; a pressure regulator configured to regulate a pressure of a gas in the pressure chamber; and a buffer tank provided between the pressure chamber and the pressure regulator.

In an embodiment, the pressure regulator includes a pressure-regulating valve, a pressure gauge configured to measure the pressure of the gas at a downstream side of the pressure-regulating valve, and a valve controller configured to control an operation of the pressure-regulating valve so as to minimize a difference between a target value of the pressure in the pressure chamber and a pressure value measured by the pressure gauge.

In an embodiment, the polishing apparatus further comprises a gas delivery line configured to couple the pressure regulator to the pressure chamber; and a flow meter configured to measure a flow rate of the gas flowing in the gas delivery line. The buffer tank is in communication with the gas delivery line, and the buffer tank is located between the pressure regulator and the flow meter.

In an embodiment, the buffer tank has a structure that does not allow its interior volume to vary regardless of the pressure in the buffer tank.

In an embodiment, the buffer tank is configured to change its volume according to the pressure in the buffer tank.

In an embodiment, at least a portion of the buffer tank is formed by a structural member that is deformable according to the pressure in the buffer tank.

In an embodiment, the polishing apparatus further comprises a limiting cover located outside the buffer tank to limit deformation of the buffer tank.

In an embodiment, the structural member that is deformable according to the pressure in the buffer tank is a diaphragm.

In an embodiment, the structural member that is deformable according to the pressure in the buffer tank is a bellows tube.

In an embodiment, the buffer tank includes: a cylinder; a piston disposed in the cylinder; a rolling diaphragm that seals a gap between the cylinder and the piston; and a spring that supports the piston. The rolling diaphragm has a bent portion surrounding the piston, and the bent portion has an inverted U-shaped cross section.

In an embodiment, a height of the top ring relative to the polishing pad when the top ring is pressing the substrate against the polishing pad is constant.

In an embodiment, the polishing apparatus further comprises a gas delivery line configured to couple the pressure regulator to the pressure chamber. The buffer tank is in communication with the gas delivery line, and the buffer tank is configured to change its volume according to the pressure in the buffer tank.

In an embodiment, at least a portion of the buffer tank is formed by a structural member that is deformable according to the pressure in the buffer tank.

In an embodiment, the polishing apparatus further comprises a limiting cover located outside the buffer tank to limit deformation of the buffer tank.

In an embodiment, the structural member that is deformable according to the pressure in the buffer tank is a diaphragm.

In an embodiment, the structural member that is deformable according to the pressure in the buffer tank is a bellows tube.

In an embodiment, the buffer tank includes: a cylinder; a piston disposed in the cylinder; a rolling diaphragm that seals a gap between the cylinder and the piston; and a spring that supports the piston. The rolling diaphragm has a bent portion surrounding the piston, and the bent portion has an inverted U-shaped cross section.

In an embodiment, a height of the top ring relative to the polishing pad when the top ring is pressing the substrate against the polishing pad is constant.

In an embodiment, there is provided a polishing apparatus comprising: a rotatable polishing table for supporting a polishing pad; a rotatable top ring having a pressure chamber for pressing a substrate against the polishing pad; and a pressure regulator configured to regulate a pressure of a gas in the pressure chamber. The pressure regulator includes a pressure-regulating valve, a pressure gauge configured to measure the pressure of the gas at a downstream side of the pressure-regulating valve, and a valve controller configured to control an operation of the pressure-regulating valve so as to minimize a difference between a target value of the pressure in the pressure chamber and a pressure value measured by the pressure gauge. The valve controller has an amplification factor of not more than 0 dB when an oscillation frequency of the measured pressure value is within a predetermined frequency range. The amplification factor is a ratio of the measured pressure value to the target value. A frequency corresponding to a rotational speed of the polishing table is within the predetermined frequency range.

In an embodiment, the valve controller includes a first valve controller and a second first valve controller. The pressure regulator has a switching unit configured to switch between the first valve controller and the second valve controller. The first valve controller has the amplification factor of not more than 0 dB when the oscillation frequency of the measured pressure value is within the predetermined frequency range. The second valve controller has the amplification factor of more than 0 dB when the oscillation frequency of the measured pressure value is within the predetermined frequency range.

In an embodiment, the pressure regulator includes a band elimination filter that lowers the amplification factor of the valve controller to 0 dB or less when the oscillation frequency of the measured pressure value is within the predetermined frequency range.

In an embodiment, the polishing table and the top ring are configured to rotate at a same rotational speed.

In an embodiment, the polishing apparatus further comprises an amplification factor measuring device configured to measure the amplification factor of the valve controller. The amplification factor measuring device is configured to input a test target value into the pressure regulator while causing the test target value to oscillate at a frequency that is within the predetermined frequency range, obtain an output value of the pressure gauge while inputting the oscillating test target value into the pressure regulator, and calculate the amplification factor of the valve controller from the output value and the test target value.

In an embodiment, the polishing apparatus further comprises a tuning device configured to adjust an operation of the valve controller to allow the valve controller to have the amplification factor of not more than 0 dB when the calculated amplification factor is more than 0 dB.

According to the above-described embodiments, a volume Q of a gas storage space (including the pressure chamber of the top ring and a gas passage) increases by a volume of the buffer tank. Accordingly, a fluctuation range $\Delta Q$ that is caused by the rotations of the polishing table and the top ring becomes smaller relative to the volume Q. As a result, the fluctuation of the gas pressure due to the rotations of the polishing table and the top ring can be reduced.

According to the above-described embodiments, the buffer tank can increase the volume of the gas passage extending from the pressure regulator to the pressure chamber, thereby reducing the fluctuation of the pressure in the pressure chamber relatively. Therefore, the pressure regulator can stably control the pressure in the pressure chamber.

According to the above-described embodiments, the buffer tank can absorb the pressure fluctuation in the pressure chamber. Therefore, the pressure regulator can stably control the pressure in the pressure chamber.

According to the above-described embodiments, the amplification factor of the valve controller is 0 dB at a frequency corresponding to the rotational speed of the polishing table. Therefore, the pressure in the pressure chamber does not divergently oscillate and is stably kept at a predetermined target value.

DESCRIPTION OF EMBODIMENTS

Embodiments will be described below.

Figure 1:
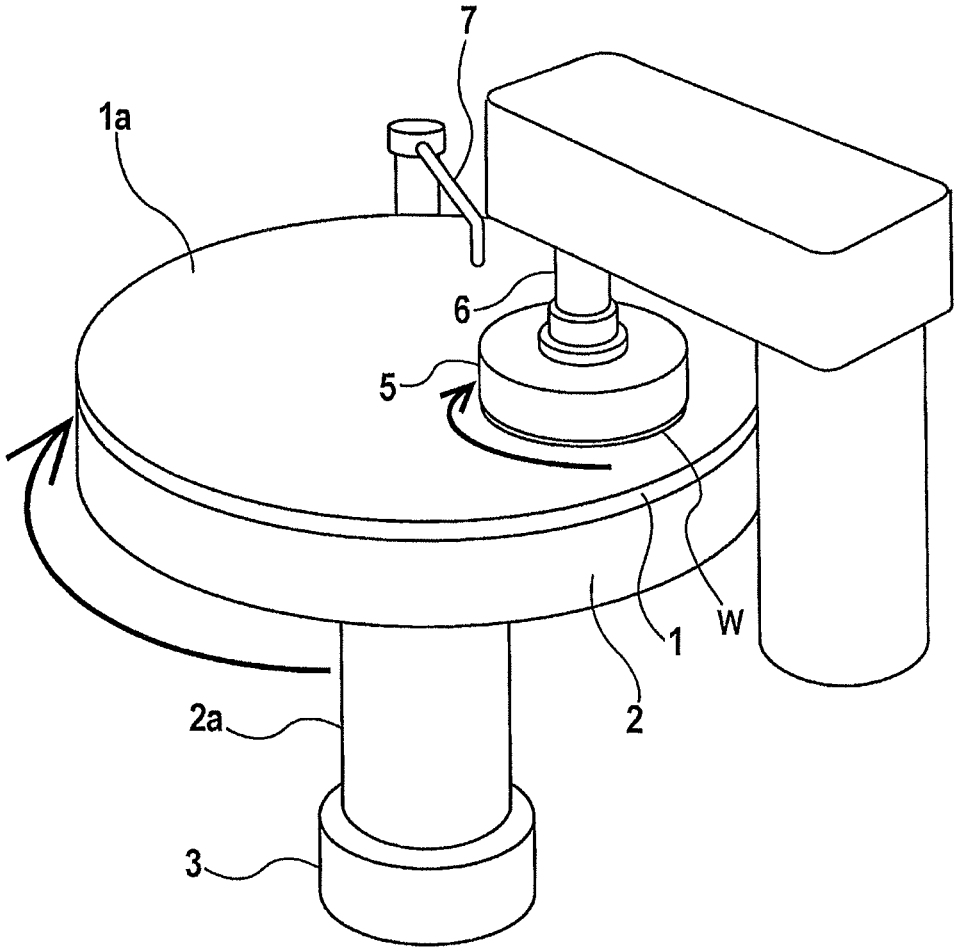
FIG. 1 is a schematic view showing a polishing apparatus for polishing a wafer.
Figure 2:
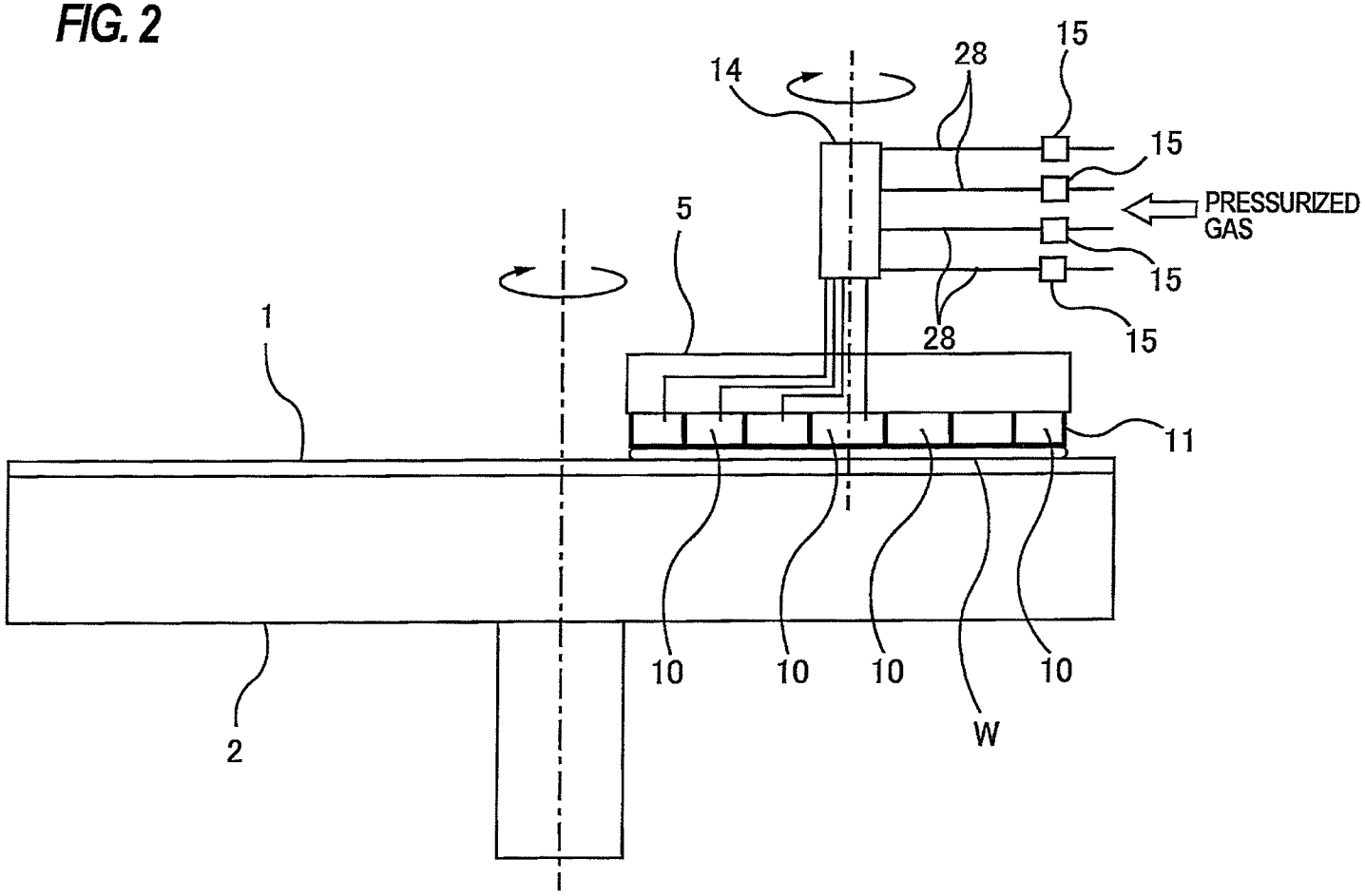
FIG. 2 is a schematic view showing a structure of a top ring.
Figure 10:
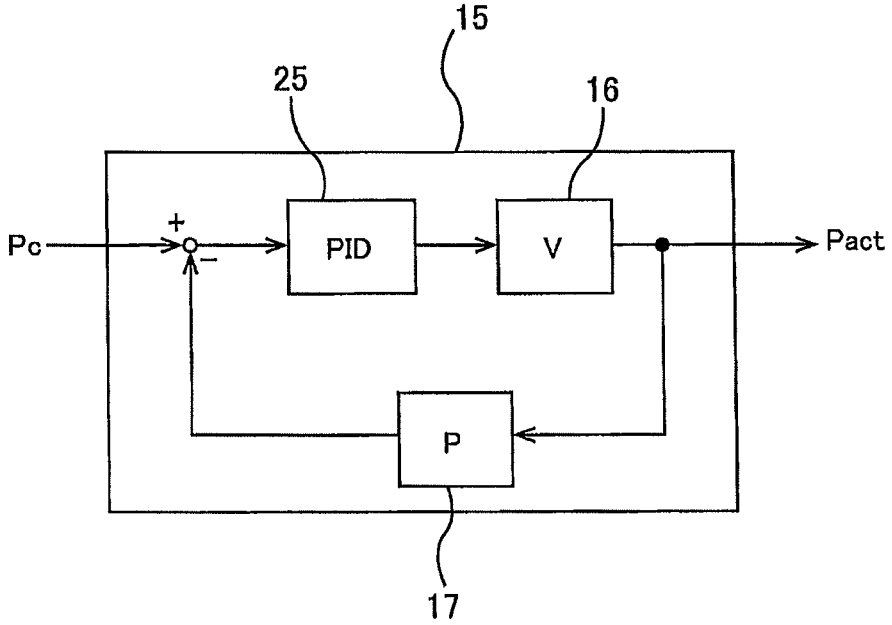
FIG. 10 is a schematic view showing an embodiment of the pressure regulator.

A polishing apparatus according to an embodiment basically has the same structure as that of the polishing apparatus shown in FIG. 1 and FIG. 2, and therefore repetitive descriptions thereof are omitted. FIG. 10 is a schematic view showing an embodiment of pressure regulator 15. This pressure regulator 15 includes pressure-regulating valve 16 for regulating pressure of a gas in the pressure chamber 10, pressure gauge 17 for measuring the pressure (outlet pressure or secondary pressure) of the gas at a downstream side of the pressure-regulating valve 16, and a valve controller 25 for controlling an operation of the pressure-regulating valve 16 so as to minimize a difference (deviation) between a target value Pc of the pressure and a pressure value Pact measured by the pressure gauge 17. The outlet pressure corresponds to the pressure in the pressure chamber 10. The target value Pc is a target value of the pressure in the pressure chamber 10 of the top ring 5.

The valve controller 25 may be a PID controller that performs a PID action, i.e., a proportional action, an integral action, and a derivative action. Manipulated variables of the proportional action, the integral action, and the derivative action, are generally determined by the deviation between the target value and the actually measured value, a proportional parameter (proportional gain), an integral parameter (proportional gain/integral time), and a derivative parameter (proportional gain*derivative time). The proportional parameter, the integral parameter, and the derivative parameter are preset constants. The controlling operation of the valve controller 25 is adjusted with use of these parameters.

Figure 11:
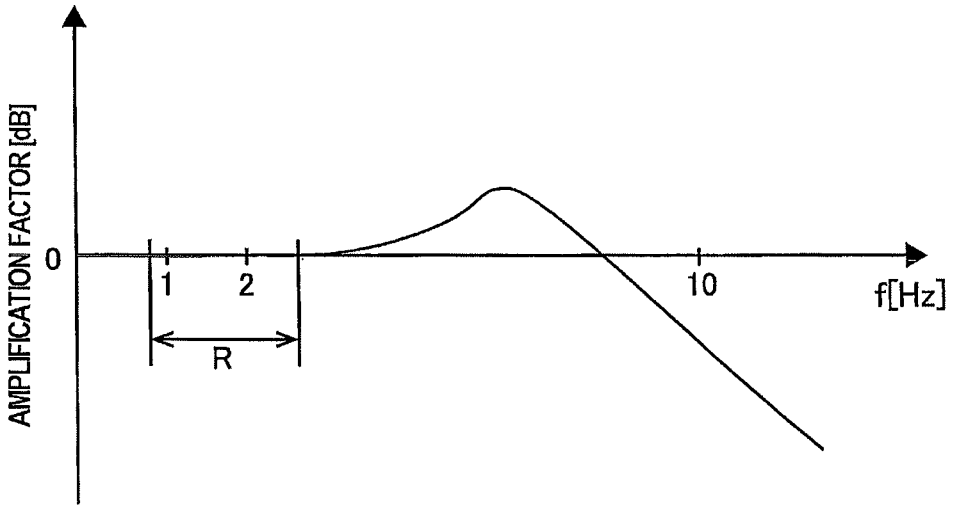
FIG. 11 is a graph showing a frequency response characteristic of the valve controller shown in FIG. 10.

FIG. 11 is a graph showing a frequency response characteristic of the valve controller 25 shown in FIG. 10. A vertical axis in FIG. 11 represents amplification factor which is a ratio of the actual pressure (actually measured value) Pact to the target value Pc. The amplification factor is expressed with use of decibel [dB] as unit. Specifically, in a case where the ratio of the actual pressure Pact to the target value Pc (Pact/Pc) is 1, i.e., in a case where the actual pressure Pact is equal to the target value Pc, the amplification factor is 0 dB.

Figure 3:
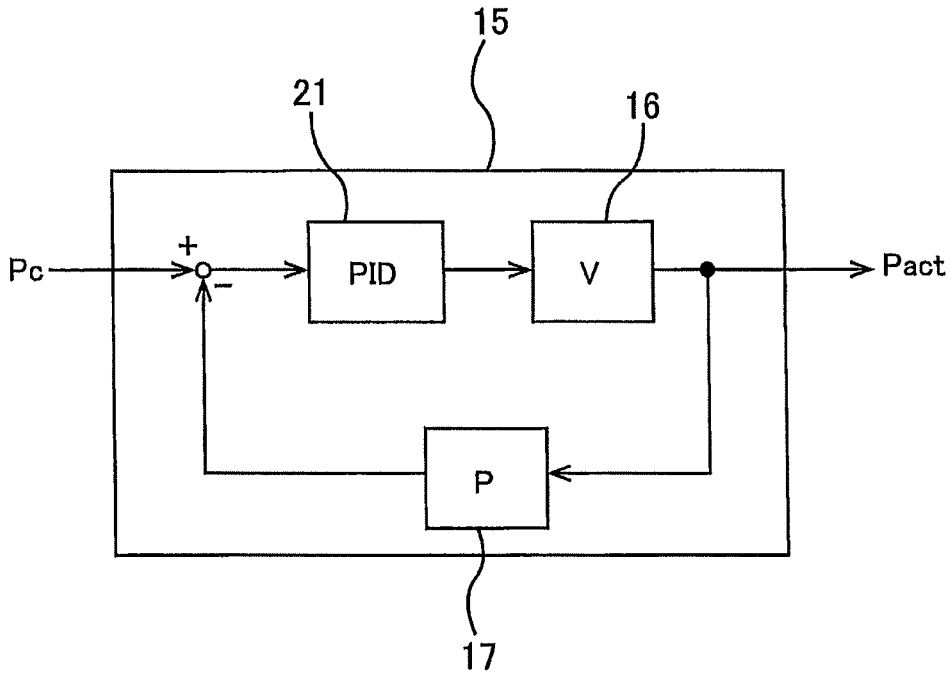
FIG. 3 is a schematic view of a pressure regulator.
Figure 4:
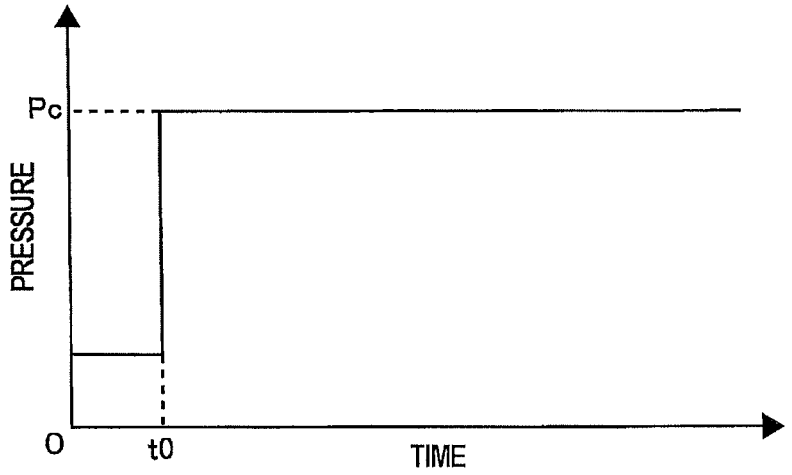
FIG. 4 is a graph showing a relationship between a target value Pc inputted into the pressure regulator and time.
Figure 5:
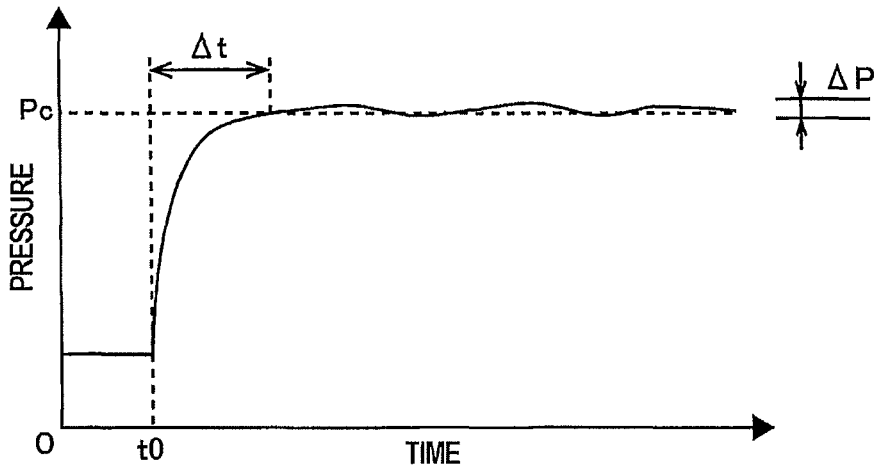
FIG. 5 is a graph showing an actual pressure (a measured pressure value) Pact measured by a pressure gauge.
Figure 6:
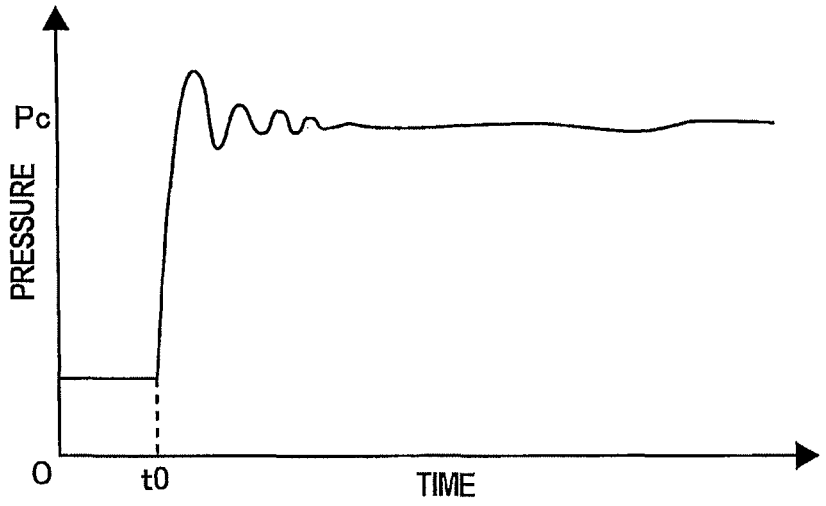
FIG. 6 is a graph showing overshoot of the pressure Pact.
Figure 7:
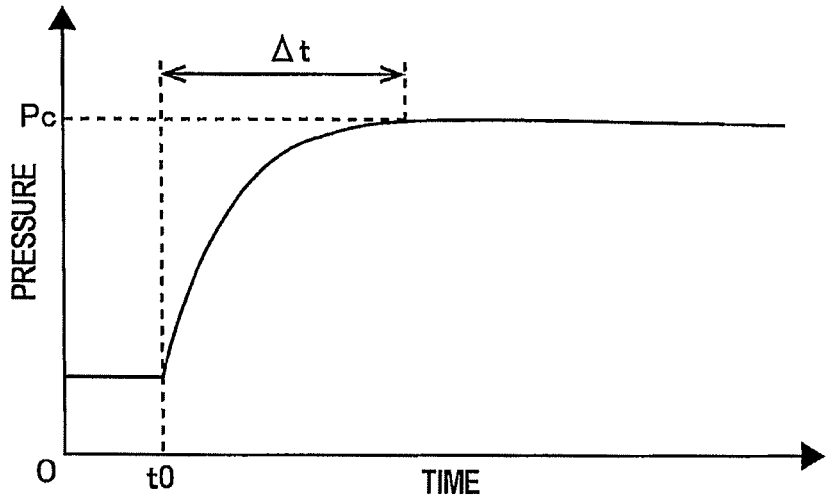
FIG. 7 is a graph showing the pressure Pact when a longer response time is set in the pressure regulator.
Figure 8:
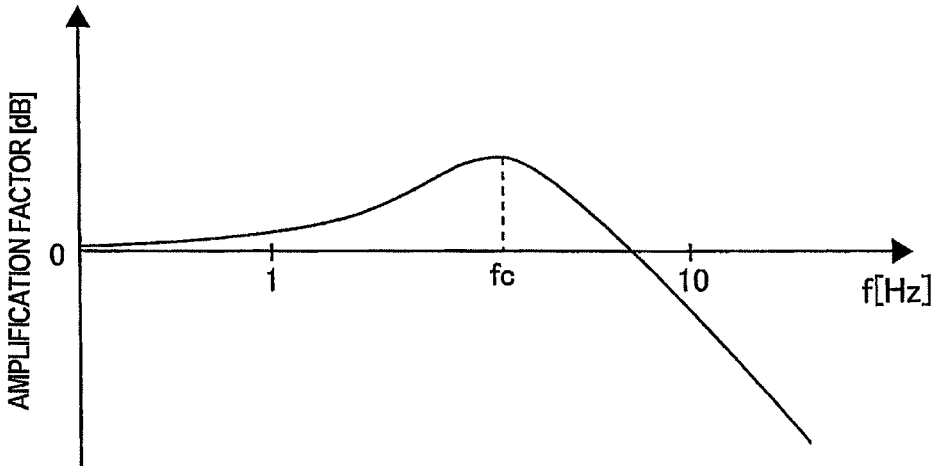
FIG. 8 is a graph showing a frequency response characteristic of a valve controller.
Figure 9:
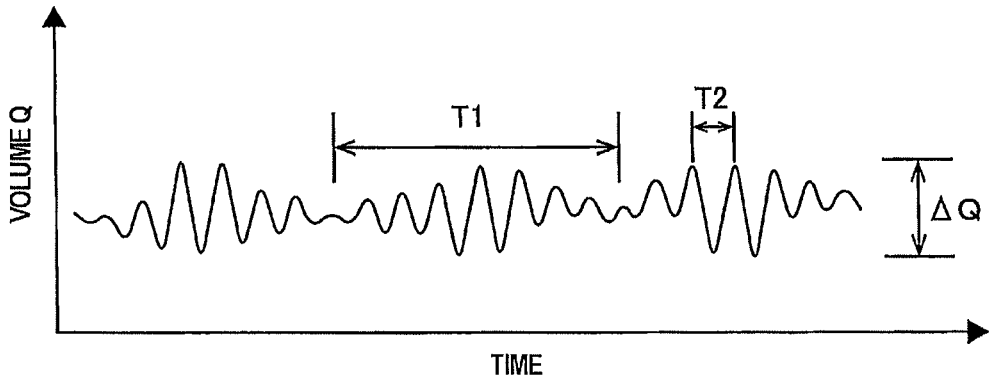
FIG. 9 is a graph showing a change in a volume of a gas storage space (pressure chambers and gas passages) when a polishing table and the top ring are rotated at different rotational speeds.

A horizontal axis in FIG. 11 represents frequency of an input control signal inputted into the valve controller 25. The input control signal includes not only the pressure target value Pc, but also a difference between the pressure target value Pc and the pressure value Pact which is a feedback value. The pressure target value Pc is constant as shown in FIG. 3, while the pressure value Pact slightly fluctuates periodically with the rotations of the polishing table 2 and the top ring 5. As a result, the input control signal also fluctuates. The frequency of the input control signal corresponds to an oscillation frequency of the pressure value Pact, and this oscillation frequency of the pressure value Pact corresponds to a frequency calculated from the rotational speeds of the polishing table 2 and the top ring 5. The horizontal axis in FIG. 11 represents this frequency of the fluctuating input control signal (i.e., the frequency of the measured pressure value Pact). In the following descriptions, the frequency of the input control signal will hereinafter be referred to as the oscillation frequency of the pressure value Pact.

As shown in FIG. 11, the valve controller 25 is configured to have the amplification factor of 0 dB when the oscillation frequency of the measured pressure value Pact is within a predetermined frequency range R. This frequency range R is determined from the rotational speeds of the polishing table 2 and the top ring 5 when performing polishing of a substrate, such as a wafer. Specifically, the frequency range R is determined so as to include frequencies corresponding to the rotational speeds of the polishing table 2 and the top ring 5 when performing polishing of the wafer. For example, in a case where the rotational speeds of polishing table 2 and the top ring 5 when performing polishing of the wafer are in a range of 60 $min^{-1}$ to 120 $min^{-1}$, the above-described predetermined frequency range R is a range including 1 to 2 Hz. The rotational speeds of the polishing table 2 and the top ring 5 when performing polishing of the wafer may be the same.

The amplification factor of the valve controller 25 can be adjusted by the above-described control parameters, i.e., the proportional parameter, the integral parameter, and the derivative parameter. In an example shown in FIG. 11, the amplification factor of the valve controller 25 in the predetermined frequency range R is set to 0 dB, while the amplification factor of the valve controller 25 in the frequency range R may be lower than 0 dB.

With this structure, even if the pressure value Pact oscillates in synchronization with the rotational speeds of the polishing table 2 and the top ring 5 during polishing of the wafer, the pressure value Pact does not diverge, because the amplification factor of the valve controller 25 is 0 dB in the range including the oscillation frequency of the pressure value Pact. Therefore, the pressure regulator 15 can stably regulate the pressure value Pact in response to the input of the target value Pc.

Figure 12:
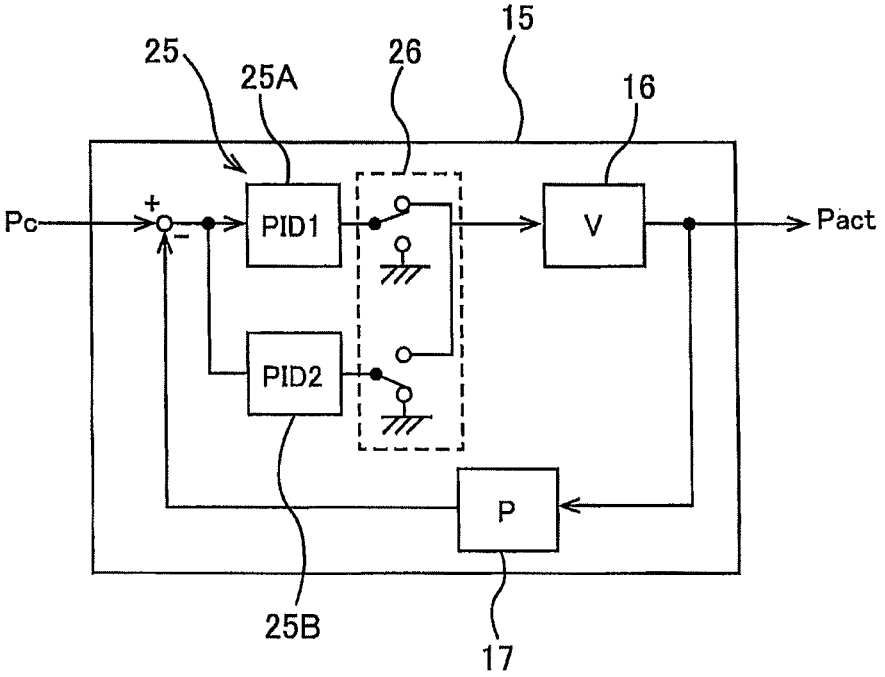
FIG. 12 is a schematic view showing another embodiment of the pressure regulator.

FIG. 12 is a schematic view showing another embodiment of the pressure regulator 15. In this embodiment, the valve controller 25 is constructed by a first valve controller 25A and a second valve controller 25B. The pressure regulator 15 has a switching unit 26 for switching between the first valve controller 25A and the second valve controller 25B, so that either the first valve controller 25A or the second valve controller 25B is coupled through the switching unit 26 to the pressure-regulating valve 16.

Figure 13:
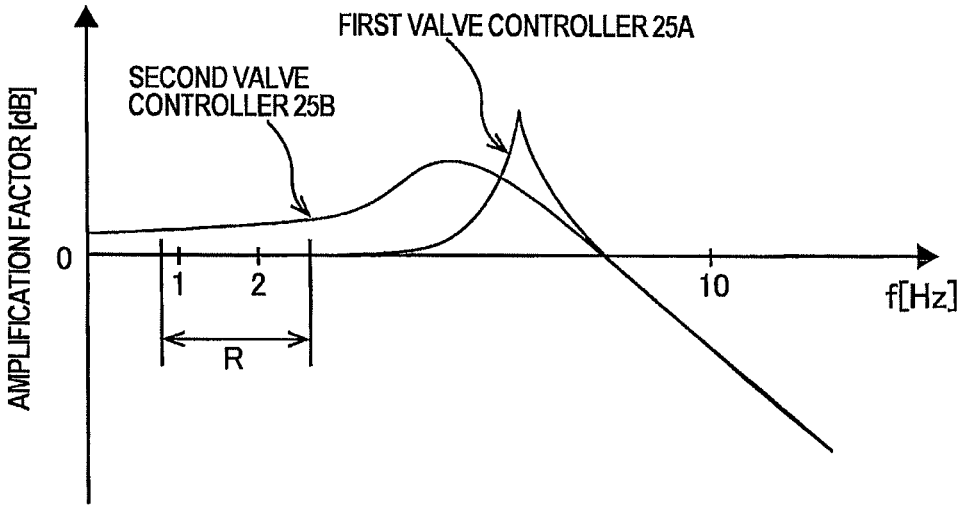
FIG. 13 is a graph showing frequency response characteristics of a first valve controller and a second valve controller shown in FIG. 12.

FIG. 13 is a graph showing frequency response characteristics of the first valve controller 25A and the second valve controller 25B shown in FIG. 12. As shown in FIG. 13, an amplification factor of the first valve controller 25A, when the oscillation frequency of the pressure value Pact is within the predetermined frequency range R, is not more than 0 dB (e.g., 0 dB in the example shown in FIG. 13). An amplification factor of the second valve controller 25B, when the oscillation frequency of the pressure value Pact is within the predetermined frequency range R, is more than 0 dB.

The switching unit 26 is operable at a predetermined timing to couple either the first valve controller 25A or the second valve controller 25B to the pressure-regulating valve 16. For example, in order to prevent the overshoot of the pressure, the switching unit 26 couples the second valve controller 25B to the pressure-regulating valve 16 before the target value Pc is inputted. Further, in order to prevent the divergent oscillation of the pressure in the pressure chamber 10, the switching unit 26 couples the first valve controller 25A to the pressure-regulating valve 16 during polishing of the wafer. Use of the two valve controllers 25A, 25B having different frequency response characteristics can stabilize the pressure during polishing while preventing the overshoot of the pressure.

Figure 14:
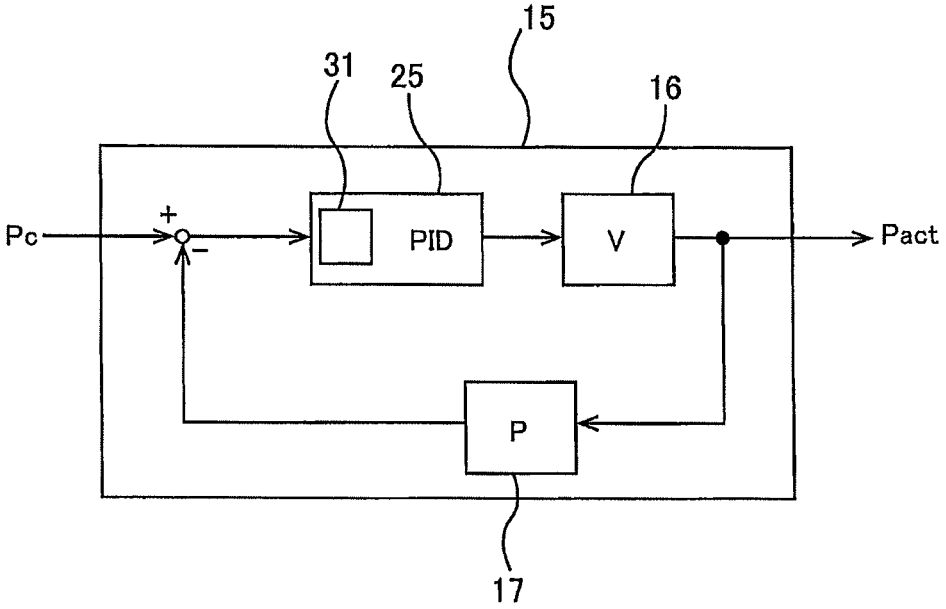
FIG. 14 is a schematic view showing still another embodiment of the pressure regulator.

FIG. 14 is a schematic view showing still another embodiment of the pressure regulator 15. This embodiment is the same as the embodiment shown in FIG. 10 in that single valve controller 25 is provided, but is different in that the valve controller 25 includes a band elimination filter 31. This band elimination filter 31 is a filter configured to lower the amplification factor of the valve controller 25 to 0 dB or less when the oscillation frequency of the measured pressure value Pact is within the predetermined frequency range R.

Figure 15:
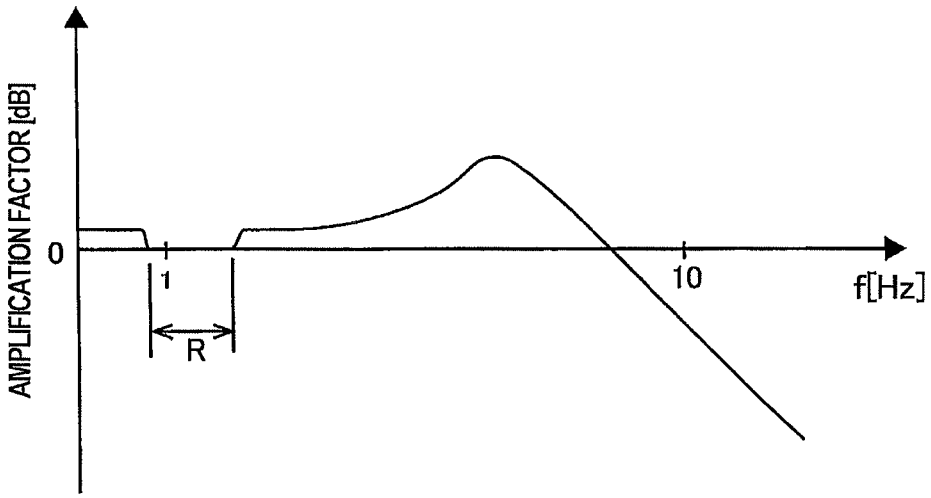
FIG. 15 is a graph showing a frequency response characteristic of the valve controller shown in FIG. 14.

FIG. 15 is a graph showing the frequency response characteristic of the valve controller 25 shown in FIG. 14. As shown in FIG. 15, in the predetermined frequency range R, the amplification factor is not more than 0 dB (e.g., 0 dB in the example shown in FIG. 15) due to the operation of the band elimination filter 31. The band elimination filter 31 may be located upstream or downstream of the valve controller 25.

As a solution to ensure that the pressure Pact does not divergently oscillate under the condition that the rotational speeds of the polishing table 2 and the top ring 5 are the same, a component having frequencies corresponding to the rotational speeds of the polishing table 2 and the top ring 5 may be removed by a filter from the pressure value Pact which is the feedback value. By using such a filter, a small oscillation of the pressure Pact caused by the rotations of the polishing table 2 and the top ring 5 can be removed.

Figure 16:
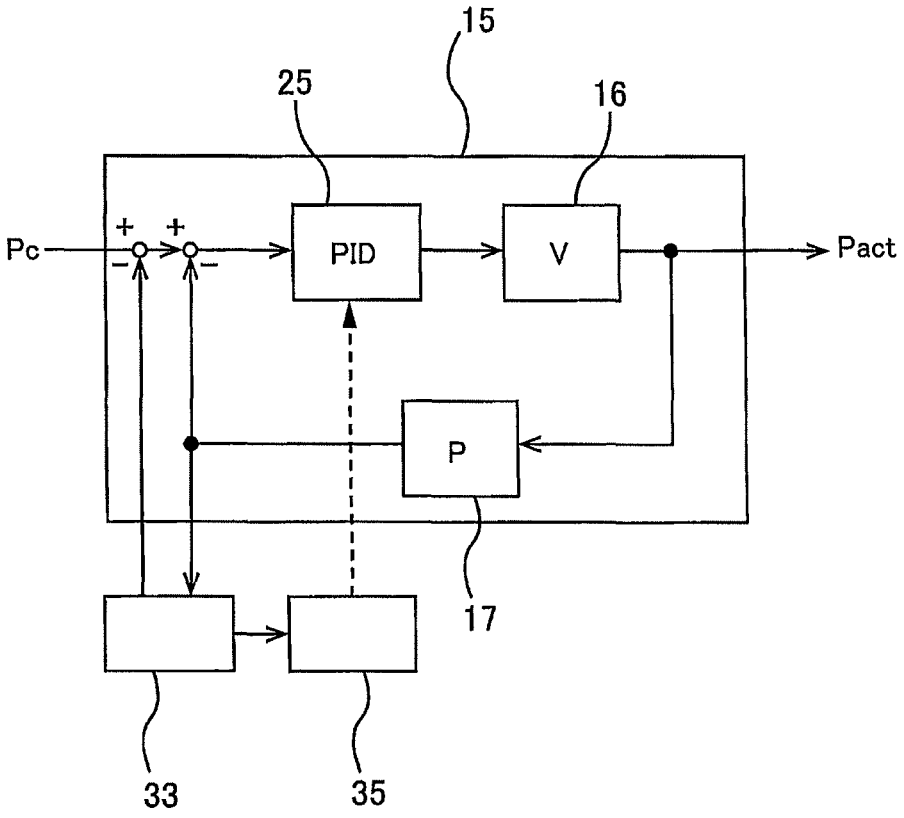
FIG. 16 is a schematic view showing an embodiment of the polishing apparatus including an amplification factor measuring device for measuring an amplification factor of the valve controller.

FIG. 16 is a schematic view showing an embodiment of the polishing apparatus including an amplification factor measuring device 33 for measuring the amplification factor of the valve controller 25. The amplification factor measuring device 33 is configured to input a test target value into the pressure regulator 15 while causing the test target value to oscillate at a frequency that is within the above-described predetermined frequency range R. The test target value is a predetermined value, and may be the above-described target value Pc. The pressure gauge 17 measures the pressure of the gas at the downstream side of the pressure-regulating valve 16 (i.e., the pressure at an outlet side of the pressure-regulating valve 16) when the oscillating test target value is inputted into the pressure regulator 15, while the amplification factor measuring device 33 obtains output value of the pressure gauge 17.

Further, the amplification factor measuring device 33 calculates the amplification factor of the valve controller 25 from the test target value and the output value of the pressure gauge 17. More specifically, the amplification factor measuring device 33 calculates the amplification factor of the valve controller 25 from a ratio of the output value to the test target value. As described above, the amplification factor is expressed with use of decibel [dB] as unit. Therefore, the ratio of the output value to the test target value is expressed as a logarithm (a logarithm to a base 10).

The amplification factor measuring device 33 is coupled to a tuning device 35 that is configured to adjust the operation of the valve controller 25. When the amplification factor measured by the amplification factor measuring device 33 is more than 0 dB, the tuning device 35 adjusts the control operation of the valve controller 25 so that the amplification factor is at most 0 dB. The tuning device 35 is configured to adjust the operation of the valve controller 25 by changing the proportional parameter, the integral parameter, and the derivative parameter described above.

The purpose of oscillating the test target value at a frequency within the predetermined frequency range R is to imitate the fluctuation of the pressure in the pressure chamber 10 of the top ring 5 that is caused by the rotations of the polishing table 2 and the top ring 5. Therefore, the measurement of the amplification factor is performed when the polishing table 2 and the top ring 5 are not rotated. Since the operation of the valve controller 25 is adjusted based on the measured value of the amplification factor, the pressure regulator 15 can eliminate the influence of the rotations of the polishing table 2 and the top ring 5 and can stably control the pressure in the pressure chamber 10.

Figure 17:
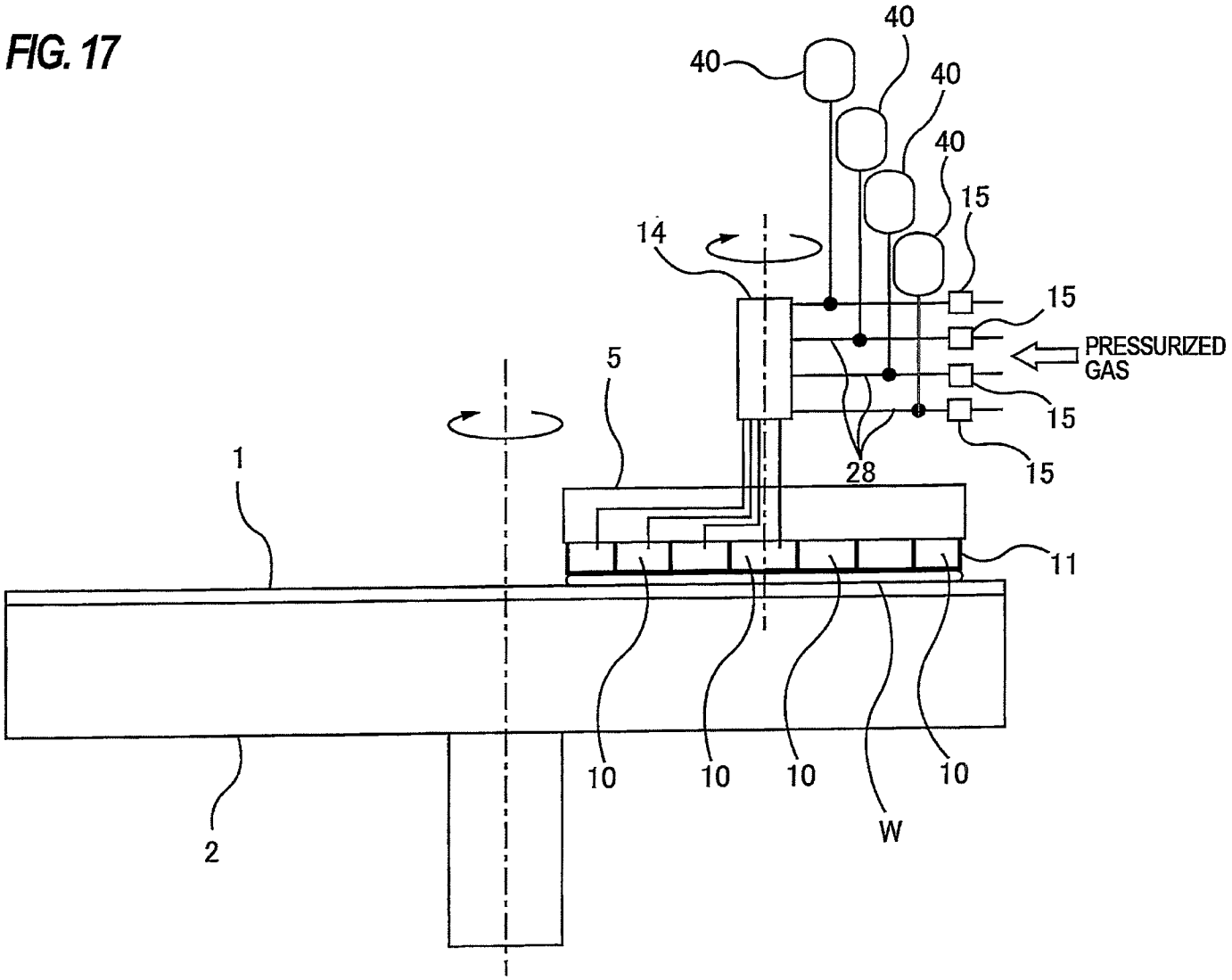
FIG. 17 is a schematic view showing an embodiment of the polishing apparatus including gas tanks.

FIG. 17 is a schematic view showing an embodiment of the polishing apparatus including gas tanks (or buffer tanks) 40. The gas tanks 40 are disposed between the pressure chambers 10 of the top ring 5 and the pressure regulators 15. As shown in FIG. 17, each of the gas tanks 40 is provided for each of the pressure chambers 10 and each of the pressure regulators 15. Each gas tank 40 is coupled to gas passage (gas delivery line) 28 that couples the pressure chamber 10 to the pressure regulator 15, so that each gas tank 40 is in communication with each pressure chamber 10. Therefore, the volume Q of the above-described gas storage space (including the pressure chambers 10 of the top ring 5 and the gas passages 28) increases by a volume of the gas tanks 40, and the fluctuation range $\Delta Q$ caused by the rotation of the polishing table 2 and the top ring 5 becomes small relative to the volume Q. As a result, the fluctuation of the gas pressure caused by the rotations of the polishing table 2 and the top ring 5 can be reduced. The gas tanks 40 serve as buffer tanks capable of reducing the fluctuation of the gas pressure.

Figure 18:
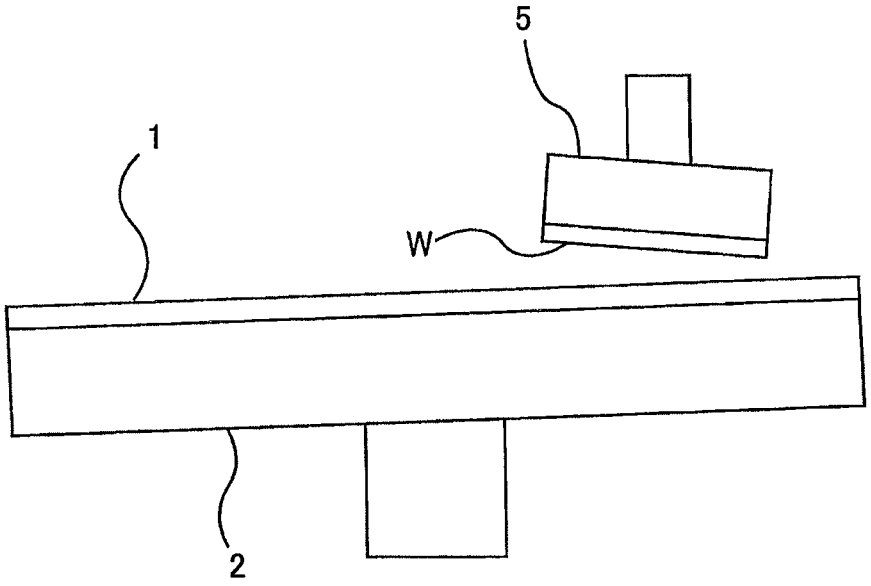
FIG. 18 is a view showing a state in which the polishing table and the top ring are inclined from rotational axes thereof.

As shown in FIG. 18, if the polishing table 2 and the top ring 5 are inclined from rotation axes thereof, the volume of the pressure chambers 10 of the top ring 5 periodically fluctuates with the rotations of the polishing table 2 and the top ring 5. Therefore, in order to minimize such a volume fluctuation of the pressure chambers 10 during polishing of a wafer, it is preferable to rotate the polishing table 2 and the top ring 5 at the same rotational speed, while a phase angle at which the inclination of the top ring 5 is maximized is in agreement with a phase angle at which the inclination of the polishing table 2 is maximized. In this case, it is preferable to provide rotary encoders (not shown) for measuring the phase angles of the polishing table 2 and the top ring 5.

Figure 19A:
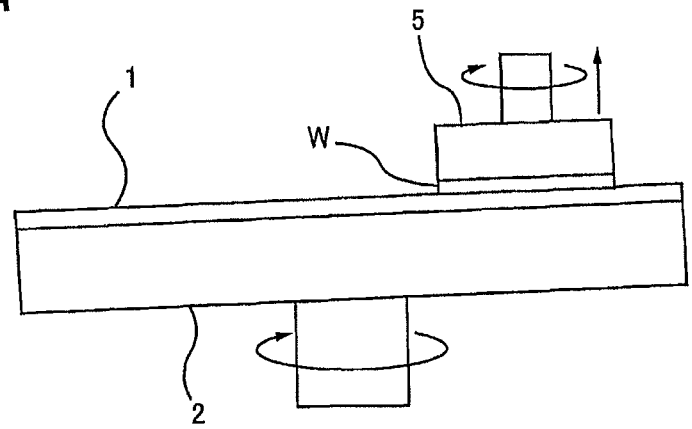
FIG. 19A, FIG. 19B, and FIG. 19C are views each showing a state in which the polishing table and the top ring are rotated with their phase angles in synchronization with each other.
Figure 19B:
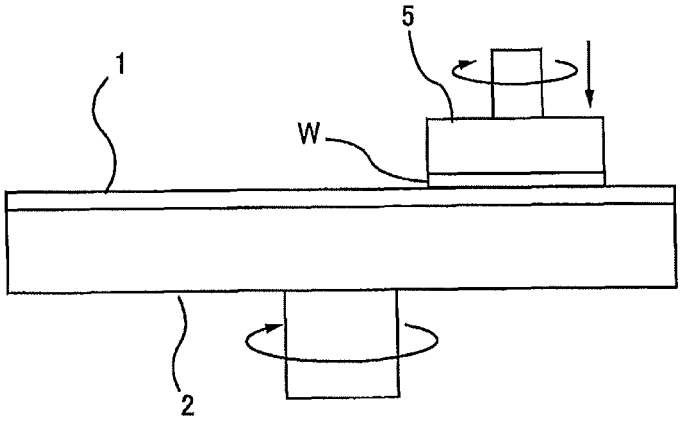
Figure 19C:
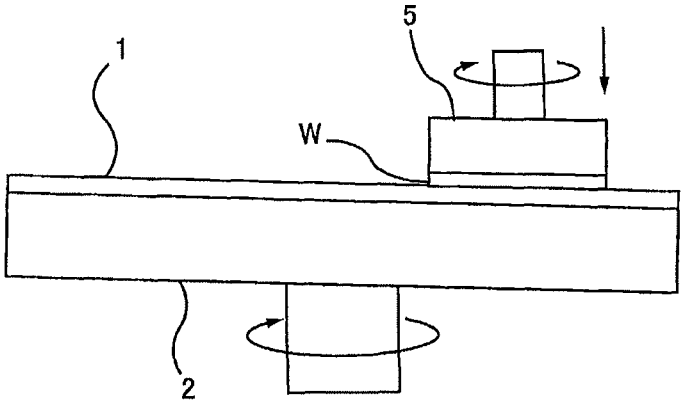

FIG. 19A through FIG. 19C are views each showing a state in which the polishing table 2 and the top ring 5 are rotated with their phase angles in synchronization with each other. The top ring 5 is moved up and down in synchronization with the rotation of the polishing table 2, while the top ring 5 is rotating with its phase angle, at which the inclination of the top ring 5 is maximized, in agreement with the phase angle of the polishing table 2 at which the inclination of the polishing table 2 is maximized. Specifically, the top ring 5 and the polishing table 2 are rotated while the top ring 5 is moved upwardly and downwardly so that a relative position in the vertical direction and a relative angle between the top ring 5 and the polishing table 2 are kept constant. In this embodiment, in order to synchronize the phase angles of the polishing table 2 and the top ring 5, the polishing table 2 and the top ring 5 are rotated at the same rotational speed. With this operation, the fluctuation range ΔQ of the volume Q of the gas storage space (including the pressure chambers 10 and the gas passages 28) can be minimized. As a result, it is possible to stabilize the pressure in the pressure chambers 10 during polishing of the wafer.

The polishing apparatus according to the embodiments described above includes the multiple pressure chambers 10 and the corresponding multiple pressure regulators 15, while the polishing apparatus may include a single pressure chamber 10 and a single pressure regulator 15.

Figure 20:
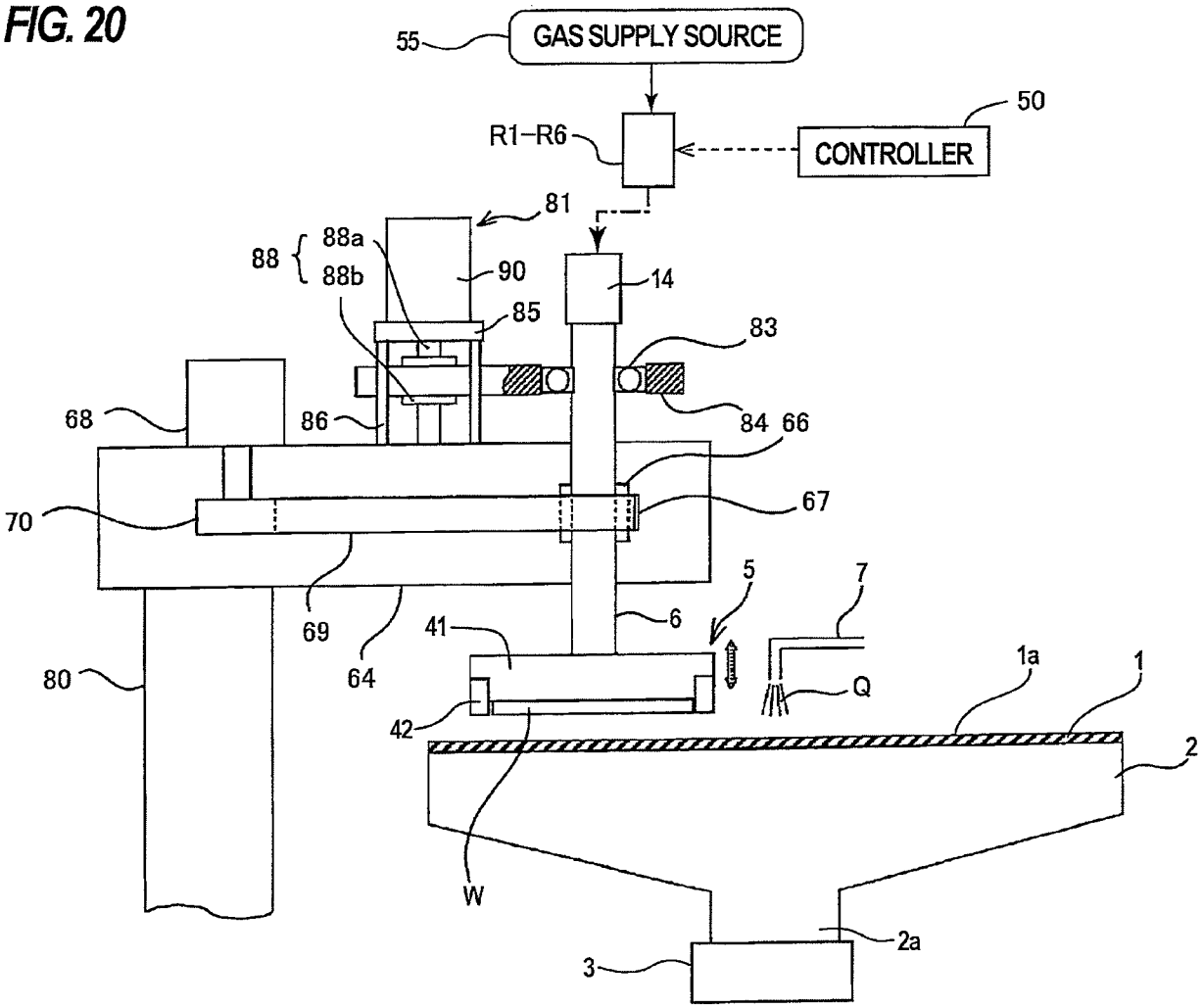
FIG. 20 is a view showing polishing apparatus according to an embodiment.

Next, another embodiment of the polishing apparatus will now be described with reference to the drawings. FIG. 20 is a view showing another embodiment of the polishing apparatus. As shown in FIG. 20, the polishing apparatus includes a polishing table 2 supporting a polishing pad 1, and a top ring (or a substrate holder) 5 for holding a substrate (e.g., a wafer), which is a workpiece to be polished, and pressing the substrate against the polishing pad 1 on the polishing table 2.

The polishing table 2 is coupled via a table shaft 2*a* to a table motor 3 which is disposed below the polishing table 2, and the polishing table 2 is rotatable about the table shaft 2*a*. The polishing pad 1 is attached to an upper surface of the polishing table 2. The polishing pad 1 has a surface 1*a* that serves as a polishing surface for polishing a wafer W. A polishing liquid supply nozzle 7 is provided above the polishing table 2 to supply a polishing liquid Q onto the polishing pad 1 on the polishing table 2.

The top ring 5 includes a top ring body 41 for pressing the wafer W against the polishing surface 1*a*, and a retaining ring 42 for retaining the wafer W therein so as to prevent the wafer W from slipping out of the top ring 5. The top ring 5 is connected to a top ring shaft 6, which is vertically movable relative to a top ring head 64 by a vertically moving mechanism 81. This vertical movement of the top ring shaft 6 causes the top ring 5 in its entirety to move upward and downward relative to the top ring head 64 and enables positioning of the top ring 5. A rotary joint 14 is mounted to an upper end of the top ring shaft 6.

The vertically moving mechanism 81 for elevating and lowering the top ring shaft 6 and the top ring 5 includes a bridge 84 that rotatably supports the top ring shaft 6 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the top ring head 64 through the support posts 86.

The ball screw 88 includes a screw shaft 88*a* coupled to the servomotor 90 and a nut 88*b* that engages with the screw shaft 88*a*. The top ring shaft 6 is vertically movable together with the bridge 84. When the servomotor 90 is set in motion, the bridge 84 moves vertically through the ball screw 88, so that the top ring shaft 6 and the top ring 5 move vertically.

The top ring shaft 6 is coupled to a rotary sleeve 66 by a key (not shown). A timing pulley 67 is secured to a circumferential surface of the rotary sleeve 66. A top ring motor 68 is fixed to the top ring head 64. The timing pulley 67 is coupled through a timing belt 69 to a timing pulley 70, which is mounted to the top ring motor 68. When the top ring motor 68 is set in motion, the rotary sleeve 66 and the top ring shaft 6 are rotated together with the timing pulley 70, the timing belt 69, and the timing pulley 67, thus rotating the top ring 5. The top ring head 64 is supported by a top ring head shaft 80, which is rotatably supported by a frame (not shown). The polishing apparatus includes a polishing controller 50 for controlling devices including the top ring motor 68 and the servomotor 90.

The top ring 5 is configured to be able to hold the wafer W on its lower surface. The top ring head 64 is configured to be able to pivot on the top ring head shaft 80. Thus, the top ring 5, when holding the wafer W on its lower surface, is moved from a position at which the top ring 5 receives the wafer W to a position above the polishing table 2 by a pivotal movement of the top ring head 64. Polishing of the wafer W is performed as follows. The top ring 5 and the polishing table 2 are rotated individually, while the polishing liquid Q is supplied from the polishing liquid supply nozzle 7, located above the polishing table 2, onto the polishing pad 1. In this state, the top ring 5 is lowered to a predetermined position (i.e., a predetermined height) and then presses the wafer W against the polishing surface 1*a* of the polishing pad 1. The wafer W is placed in sliding contact with the polishing surface 1*a* of the polishing pad 1, so that a surface of the wafer W is polished.

Figure 21:
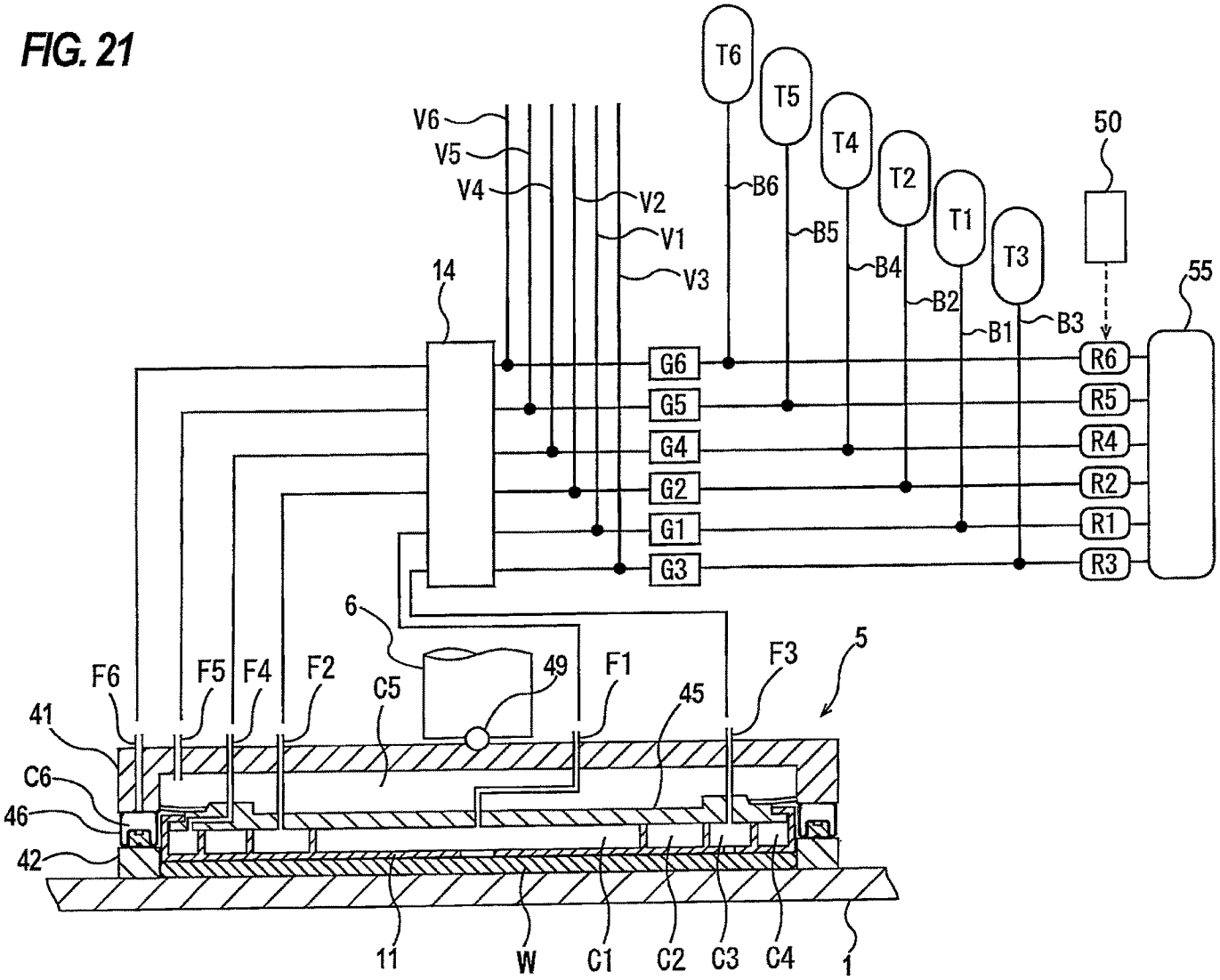
FIG. 21 is a cross-sectional view showing top ring.

Next, the top ring 5 will be described. FIG. 21 is a cross-sectional view showing the top ring 5. The top ring 5 has the top ring body 41 coupled to the top ring shaft 6 via a universal joint 49, and the retaining ring 42 provided below the top ring body 41.

A flexible membrane (elastic membrane) 11 to be brought into contact with the wafer W and a chucking plate 45 that holds the membrane 11 are disposed below the top ring body 41. Four pressure chambers (or air bags) C1, C2, C3, and C4 are provided between the membrane 11 and the chucking plate 45. The pressure chambers C1, C2, C3, and C4 are formed by the membrane 11 and the chucking plate 45. The central pressure chamber C1 has a circular shape, and the other pressure chambers C2, C3, and C4 have an annular shape. These pressure chambers C1, C2, C3, and C4 are in a concentric arrangement.

Pressurized gas (pressurized fluid), such as pressurized air, is supplied through gas delivery lines F1, F2, F3, and F4 into the pressure chambers C1, C2, C3, and C4, respectively, by a gas supply source (i.e., a fluid supply source) 55. Vacuum lines V1, V2, V3, and V4 are coupled to the gas delivery lines F1, F2, F3, and F4, respectively, so that negative pressure can be produced in the pressure chambers C1, C2, C3, and C4 by the vacuum lines V1, V2, V3, and V4. The pressures in the pressure chambers C1, C2, C3, and C4 can be changed independently to thereby independently adjust polishing pressures on four zones of the wafer W: a central portion; an inner intermediate portion; an outer intermediate portion; and a peripheral portion. Further, by elevating or lowering the top ring 5 in its entirety, the retaining ring 42 can press the polishing pad 1 at a predetermined pressure.

A pressure chamber C5 is formed between the chucking plate 45 and the top ring body 41. The pressurized gas is supplied through a gas delivery line F5 into the pressure chamber C5 by the gas supply source 55. Further, a vacuum line V5 is coupled to the gas delivery line F5, so that negative pressure can be produced in the pressure chamber C5 by the vacuum line V5. With these operations, the chucking plate 45 and the membrane 11 in their entirety can move up and down.

The retaining ring 42 is arranged around the periphery of the wafer W so as to prevent the wafer W from coming off the top ring 5 during polishing. The membrane 11 has an opening in a portion that forms the pressure chamber C3, so that the wafer W can be held on the top ring 5 by vacuum suction when a vacuum is produced in the pressure chamber C3. Further, the wafer W can be released from the top ring 5 by supplying nitrogen gas or clean air into the pressure chamber C3.

An annular rolling diaphragm 46 is provided between the top ring body 41 and the retaining ring 42. A pressure chamber C6 is formed in this rolling diaphragm 46, and is in communication with the gas supply source 55 through a gas delivery line F6. The gas supply source 55 supplies the pressurized gas into the pressure chamber C6, so that the rolling diaphragm 46 presses the retaining ring 42 against the polishing pad 1. Further, a vacuum line V6 is coupled to the gas delivery line F6 so that negative pressure can be produced in the pressure chamber C6 by the vacuum line V6. When a vacuum is produced in the pressure chamber C6, the retaining ring 42 in its entirety is elevated.

The gas delivery lines (gas passages) F1, F2, F3, F4, F5, and F6, communicating with the pressure chambers C1, C2, C3, C4, C5, and C6, respectively, are provided with electropneumatic regulators (which are pressure regulators) R1, R2, R3, R4, R5, and R6, respectively. The pressurized gas from the gas supply source 55 is supplied through the electropneumatic regulators R1 to R6 into the pressure chambers C1 to C6. These electropneumatic regulators R1 to R6 are configured to regulate the pressure in the pressure chambers C1 to C6 by regulating the pressure of the pressurized gas supplied from the gas supply source 55. The electropneumatic regulators 121 to R6 are coupled to the polishing controller 50. The pressure chambers C1 to C6 are further coupled to vent valves (not shown), respectively, so that the pressure chambers C1 to C6 can be ventilated to the atmosphere. The polishing controller 50 sends target pressure values of the respective pressure chambers C1 to C6 to the electropneumatic regulators R1 to R6, which then operate such that the pressures in the pressure chambers C1 to C6 are maintained at the corresponding target pressure values.

The electropneumatic regulators R1 to R6 are coupled through the gas delivery lines F1 to F6 to the pressure chambers C1 to C6. The gas delivery lines F1 to F6 are provided with flow meters G1, G2, G3, G4, G5, and G6 for measuring flow rate of the gas flowing in the gas delivery lines F1 to F6, respectively. These flow meters G1 to G6 are used for detecting a gas leakage that might occur in the corresponding pressure chambers C1 to C6. In a case where these is no need for the detection of the gas leakage in the pressure chambers C1 to C6, the flow meters G1 to G6 may be omitted. The gas delivery lines F1 to F6 extend from the pressure chambers C1 to C6 to the electropneumatic regulators R1 to R6 via the rotary joint 14. The vacuum lines V1 to V6 are coupled respectively to the gas delivery lines F1 to F6 at locations between the pressure chambers C1 to C6 and the flow meters G1 to G6.

Buffer tanks (or gas tanks) T1, T2, T3, T4, T5, and T6 are disposed between the electropneumatic regulators R1, R2, R3, R4, R5, and R6 and the top ring 5 which is a use point of the pressurized gas. These buffer tanks T1, T2, T3, T4, T5, and T6 are coupled to the gas delivery lines (gas passages) F1, F2, F3, F4, F5, and F6, respectively, via branch lines B1, B2, B3, B4, B5, and B6. The buffer tanks T1 to T6 are located between the electropneumatic regulators R1 to R6 and the flow meters G1 to G6. In other words, the branch lines B1 to B6 are coupled respectively to the gas delivery lines F1 to F6 at locations between the electropneumatic regulators R1 to R6 and the flow meters G1 to G6. The buffer tanks T1, T2, T3, T4, T5, and T6 have the same function as the above-described gas tanks 40.

The polishing controller 50 stores in advance a target height which is an optimal value of a height of the top ring 5 relative to the polishing pad 1. During polishing of the wafer W, the height of the top ring 5 relative to the polishing pad 1 is kept at the predetermined target height. This target height is a height at which a small gap is formed between the wafer W and the polishing surface 1*a* of the polishing pad 1 when the negative pressure is produced in the pressure chambers C1 to C4 to attract the wafer W to the membrane 11. This gap becomes zero when the gas is supplied into the pressure chambers C1 to C4. The height of the top ring 5 relative to the polishing pad 1 is adjusted by the servomotor 90, and an operation of the servomotor 90 is controlled by the polishing controller 50.

In order to keep the relative height of the top ring 5 at the target height, it is necessary to detect the height of the polishing surface 1*a* of the polishing pad 1. The height of the polishing surface 1*a* of the polishing pad 1 can be detected as follows. The top ring 5 is lowered from a predetermined initial position until a lower surface of the top ring 5 (i.e., a lower surface of the retaining ring 42) is brought into contact with the polishing surface 1*a* of the polishing pad 1. When the lower surface of the top ring 5 is brought into contact with the polishing surface 1*a* of the polishing pad 1, a load on the servomotor 90 increases, resulting in an increase in a current flowing into the servomotor 90. Therefore, the polishing controller 50 can detect a point of time when the lower surface of the top ring 5 is brought into contact with the polishing surface 1*a* of the polishing pad 1 from a change in the current flowing into the servomotor 90. The polishing controller 50 stops the operation of the servomotor 90 when the lower surface of the top ring 5 is brought into contact with the polishing surface 1*a* of the polishing pad 1, thereby stopping the downward movement of the top ring 5. The polishing controller 50 calculates the height of the polishing surface 1*a* of the polishing pad 1 from the initial position of the top ring 5 and a downward distance of the top ring 5.

During polishing of the wafer W, the polishing table 2 and the top ring 5 are rotated under the condition that the height of the top ring 5 relative to the polishing pad 1 is kept constant. However, there exists a slight axial runout in bearings of the polishing table 2 and the top ring 5. As a result, the relative position in the vertical direction between the polishing table 2 and the top ring 5 is slightly varied with the rotations of the polishing table 2 and the top ring 5. This variation in the relative position causes fluctuation of the interior volumes of the pressure chambers C1 to C6, thus causing the fluctuation of the pressures in the pressure chambers C1 to C6. Thus, in order to reduce the fluctuation of the pressures in the pressure chambers C1 to C6, the buffer tanks T1 to T6 are provided in communication with the pressure chambers C1 to C6, respectively.

Figure 22:
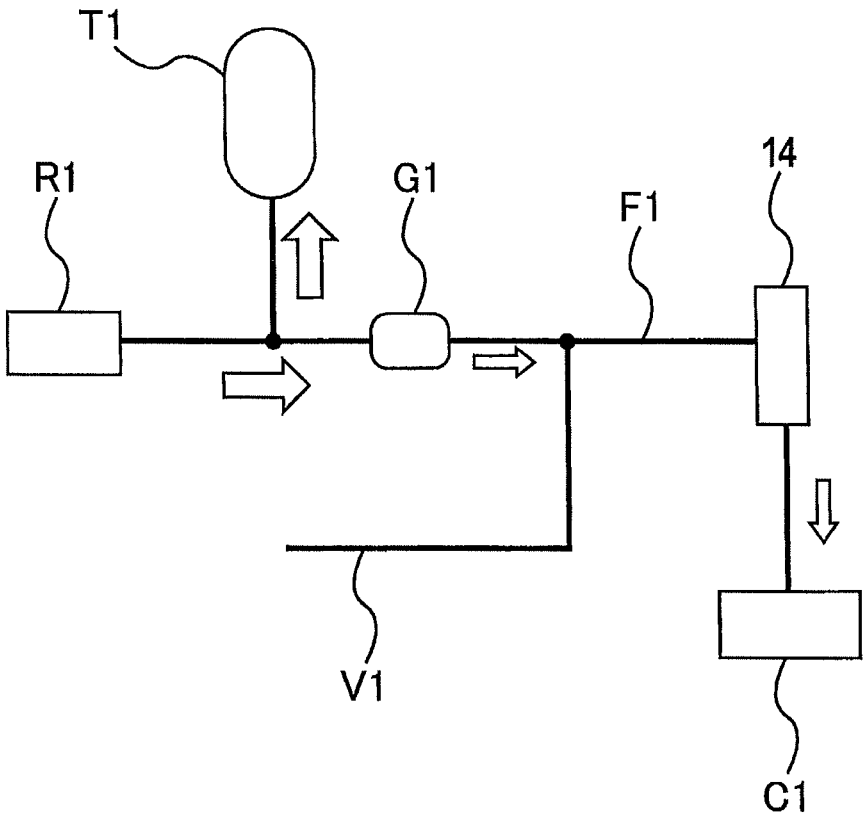
FIG. 22 is a schematic view illustrating an arrangement of a buffer tank, an electropneumatic regulator, a flow meter, and a pressure chamber.

Structures and arrangements of the buffer tanks T1 to T6 are the same as each other. Therefore, the buffer tank T1 will now be described with reference to FIG. 22. FIG. 22 is a schematic view illustrating an arrangement of the buffer tank T1, the electropneumatic regulator (i.e., the pressure regulator) R1, the flow meter G1, and the pressure chamber C1. The buffer tank T1 is a hermetic container formed by a hard material, such as metal or hard resin. The buffer tank T1 has a highly-rigid structure, and its interior volume does not substantially vary. As an example, the buffer tank T1 may be formed by PVC (polyvinyl chloride).

The buffer tank T1 is coupled to the gas delivery line F1. Therefore, the buffer tank 1 is in fluid communication with the pressure chamber C1 via the gas delivery line F1. The volume of the buffer tank T1 is equal to or larger than the volume of the pressure chamber C1. The buffer tank T1 can increase the volume of the gas passage from the electropneumatic regulator R1 to the pressure chamber C1 to thereby relatively reduce the fluctuation of the pressure in the pressure chamber C1.

The buffer tank T1 is located between the electropneumatic regulator R1 and the flow meter G1. This is because the responsiveness of the electropneumatic regulator R1 can be improved. The responsiveness of the electropneumatic regulator R1 is represented by a response time indicating a difference between a point of time at which the target pressure value is changed and a point of time at which the pressure at the downstream side of the electropneumatic regulator R1 (i.e., the outlet pressure of the electropneumatic regulator R1) reaches the target pressure value. The flow meter G1 has a throttle hole therein and is configured to measure the flow rate based on a difference between the pressure at the upstream side of the throttle hole and the pressure at the downstream side of the throttle hole. Since the buffer tank T1 is coupled to the upstream side of the flow meter G1 having such a structure, the gas that has been supplied from the electropneumatic regulator R1 is delivered into the buffer tank T1 to rapidly fill the buffer tank T1, before the flow rate of the gas is lowered by the flow meter G1. Therefore, the electropneumatic regulator R1 can rapidly change the pressure in the pressure chamber C1 in response to the change in the target pressure value. The flow meter G1 is located between the buffer tank T1 and the pressure chamber C1.

As can be seen from FIG. 22, the buffer tank T1 is located between the electropneumatic regulator R1 and the vacuum line V1. With this arrangement, when the vacuum line V1 is forming a vacuum in the pressure chamber C1, the buffer tank T1 exerts little influence on the vacuum formation. Therefore, the vacuum line V1 can quickly form the vacuum in the pressure chamber C1.

Figure 23:
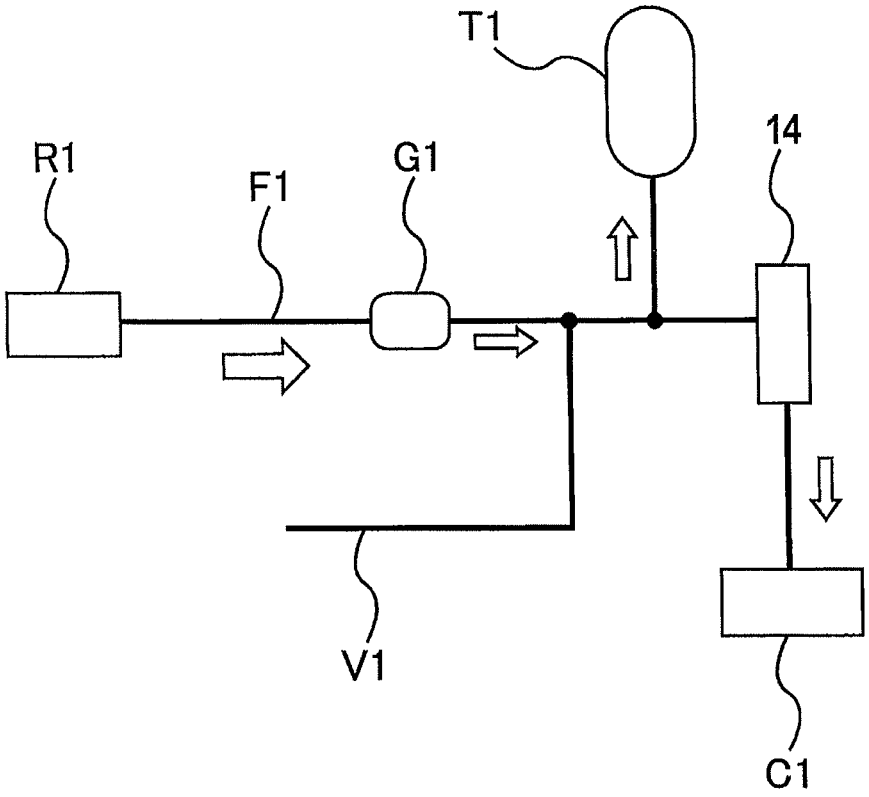
FIG. 23 is a view showing a comparative example of FIG. 22.

FIG. 23 is a view showing a comparative example of FIG. 22. In this example shown in FIG. 23, the buffer tank T1 is located between the flow meter G1 and the pressure chamber C1. With this arrangement, the gas from the electropneumatic regulator R1 is supplied into the buffer tank T1 after the flow rate of the gas is lowered by the flow meter G1. As a result, it takes a longer time to fill the buffer tank T1 with the gas, and the responsiveness is lowered. Moreover, when the vacuum is formed in the pressure chamber C1 by the vacuum line V1, the gas held in the buffer tank T1 is sucked by the vacuum line V1. As a result, it takes a longer time to form the vacuum in the pressure chamber C1.

Figure 24:
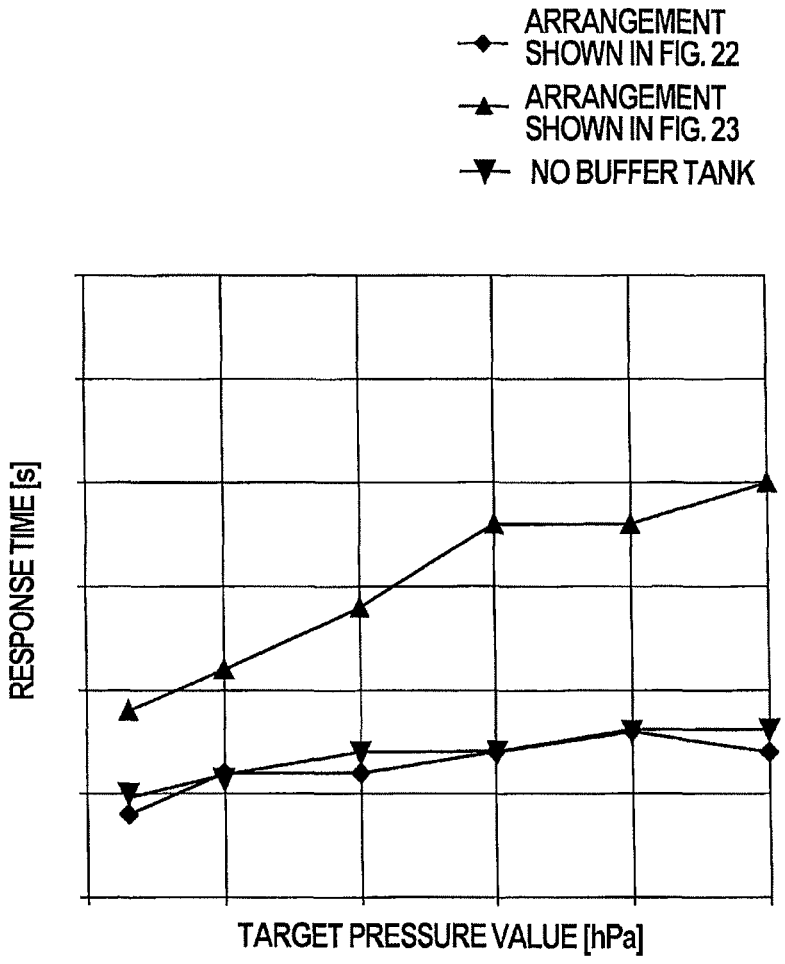
FIG. 24 is a graph showing experimental results of a response time of the electropneumatic regulator when a target pressure value is varied.

FIG. 24 is a graph showing experimental results of the response time of the electropneumatic regulator R1 when the target pressure value is varied in the arrangement shown in FIG. 22, the arrangement shown in FIG. 23, and an arrangement in which the buffer tank T1 is not provided. As can be seen from the experimental results, the arrangement shown in FIG. 22 indicates a shorter response time than that in the arrangement shown in FIG. 23. Further, the arrangement shown in FIG. 22 indicates almost the same response time as that in the arrangement in which the buffer tank T1 is not provided. This means that the buffer tank T1, located between the electropneumatic regulator R1 and the flow meter G1 as shown in FIG. 22, can bring a good responsiveness equivalent to that in the case where no buffer tank is provided.

Figure 25:
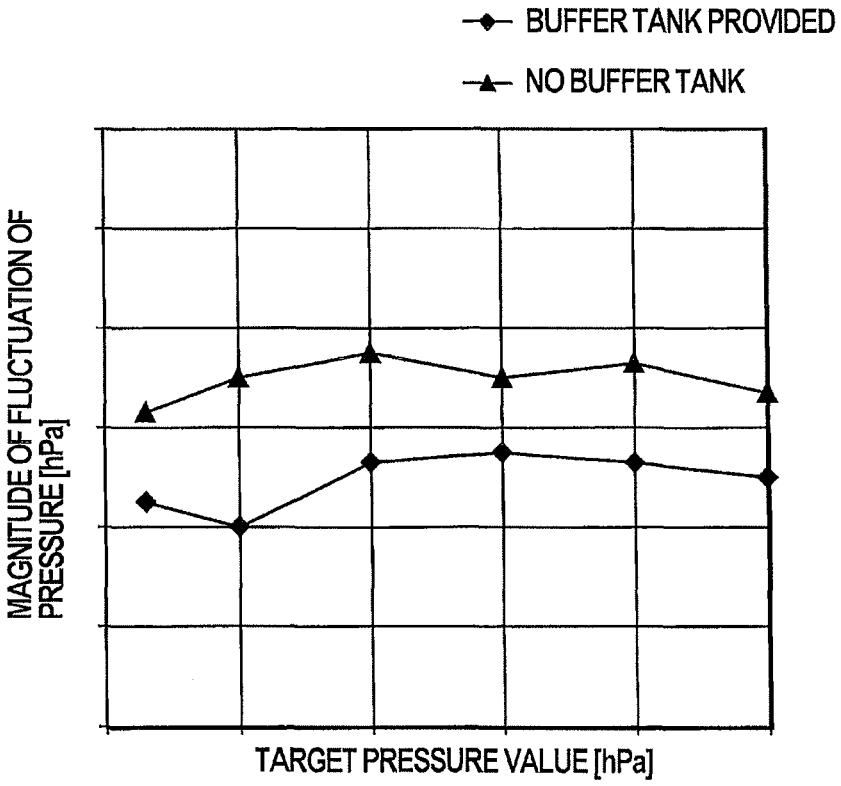
FIG. 25 is a graph showing magnitude of fluctuation of the pressure at a downstream side of the electropneumatic regulator in a case where the buffer tank is located between the electropneumatic regulator and the flow meter and in a case where the buffer tank is not provided.
Figure 26:
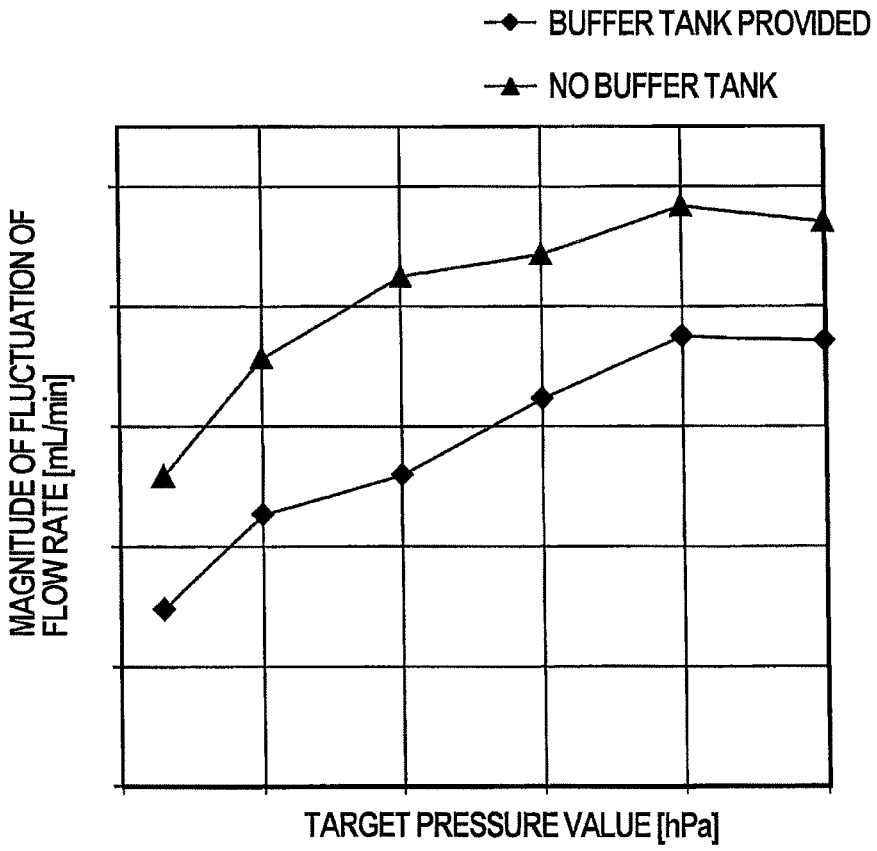
FIG. 26 is a graph showing magnitude of fluctuation of the flow rate at the downstream side of the electropneumatic regulator in the case where the buffer tank is located between the electropneumatic regulator and the flow meter and in the case where the buffer tank is not provided.

FIG. 25 is a graph showing magnitude of the fluctuation of the pressure at the downstream side of the electropneumatic regulator R1 in the case where the buffer tank T1 is provided between the electropneumatic regulator R1 and the flow meter G1 and in the case where the buffer tank T1 is not provided. FIG. 26 is a graph showing magnitude of the fluctuation of the flow rate at the downstream side of the electropneumatic regulator R1 in the case where the buffer tank T1 is provided between the electropneumatic regulator R1 and the flow meter G1 and in the case where the buffer tank T1 is not provided. In FIG. 25 and FIG. 26, the magnitude of the fluctuation of the pressure represents a difference between a maximum value and a minimum value of the pressure, and the magnitude of the fluctuation of the flow rate represents a difference between a maximum value and a minimum value of the flow rate. It can be seen from the experimental results shown in FIG. 25 and FIG. 26 that the fluctuation of the pressure and the fluctuation of the flow rate are reduced by providing the buffer tank T1.

As can be seen from the experimental results shown in FIG. 24 through FIG. 26, the buffer tank T1, provided between the electropneumatic regulator R1 and the flow meter G1, can reduce the fluctuation of the pressure and the fluctuation of the flow rate while bringing a good responsiveness equivalent to that in the case where the buffer tank is not provided. As described above, if the detection of the gas leakage in the pressure chambers C1 to C6 is not needed, the flow meters G1 to G6 may not be provided. Even in this case, the buffer tanks T1 to T6 can relatively reduce the fluctuation of the pressures in the pressure chambers C1 to C6.

Figure 27:
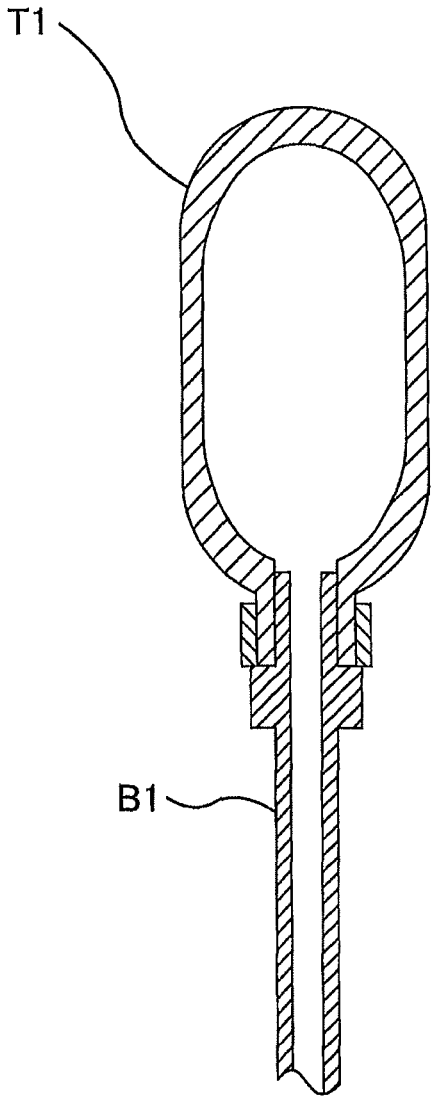
FIG. 27 is a cross-sectional view showing another example of the buffer tank.

Next, another structural example of the buffer tank T1 will be described. An arrangement of the buffer tank T1 described below is the same as the arrangement of the buffer tank T1 shown in FIG. 22. FIG. 27 is a cross-sectional view showing another example of the buffer tank T1. Other buffer tanks T2 to T6 also have the same structure and the same arrangement as those of the buffer tank T1 shown in FIG. 27.

The buffer tank T1 shown in FIG. 27 is different from the above-described buffer tank in that the volume of the buffer tank T1 changes according to the pressure in the buffer tank T1. The entirety of the buffer tank T1 of this example is formed by elastic material, such as a rubber, so that the buffer tank T1 can deform in its entirety (i.e., expand and shrink) according to the pressure in the buffer tank T1. Specifically, the entirety of the buffer tank T1 is formed from a structural member that is deformable according to the pressure therein. For example, the buffer tank T1 is formed from a rubber air-bag. Only a portion of the buffer tank T1 may be formed by elastic material, such as rubber.

Figure 28:
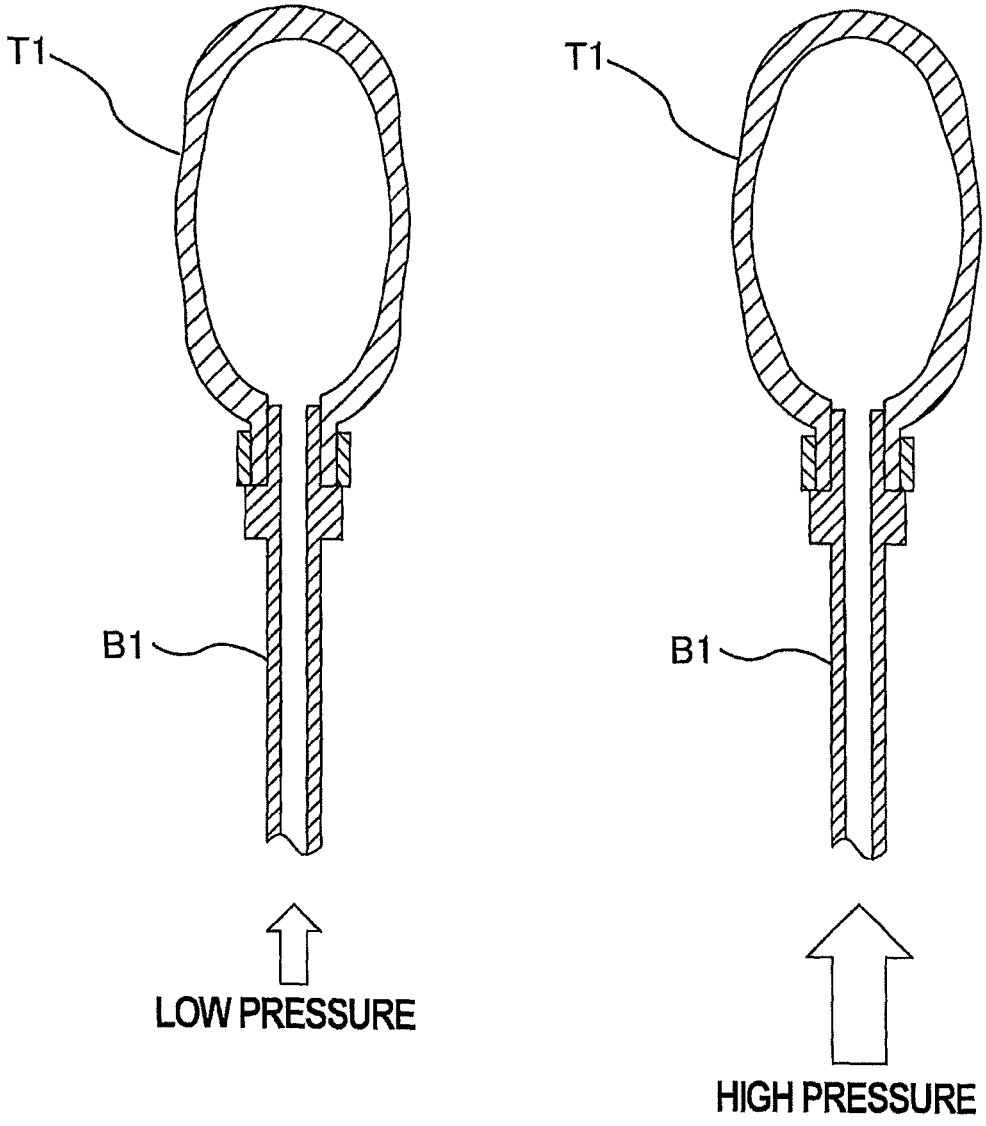
FIG. 28 is a view showing the buffer tank when the pressure therein is low and the buffer tank when the pressure therein is high.

FIG. 28 is a view showing the buffer tank T1 when the pressure therein is low and the buffer tank T1 when the pressure therein is high. As shown in FIG. 28, when the pressure in the buffer tank T1 is high, the entirety of the buffer tank T1 expands to increase the volume of the buffer tank T1. In this manner, since the volume of the buffer tank T1 is varied according to the pressure in the buffer tank T1, the buffer tank T1 can absorb the fluctuation of the pressure in the pressure chamber C1 that can occur when polishing of a wafer is performed.

Figure 29:
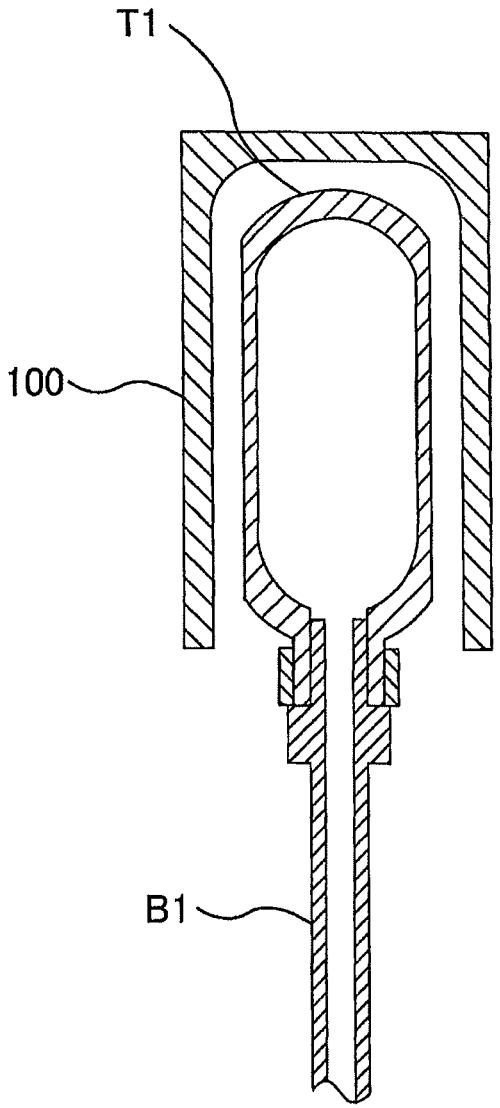
FIG. 29 is a cross-sectional view showing still another example of the buffer tank.

FIG. 29 is a cross-sectional view showing still another example of the buffer tank T1. Other buffer tanks T2 to T6 also have the same structure and the same arrangement as those of the buffer tank T1 shown in FIG. 29. This buffer tank T1 itself is the same as the buffer tank T1 shown in FIG. 27, but is different in that a limiting cover 100 is disposed outside the buffer tank T1. This limiting cover 100 has a shape that covers an upper surface and an entirety of a side surface of the buffer tank T1. The limiting cover 100 has an internal space larger than the volume of the entire buffer tank T1. The limiting cover 100 is provided for preventing a burst of the buffer tank T1 when expanding in response to the pressure increase in the buffer tank T1.

Figure 30:
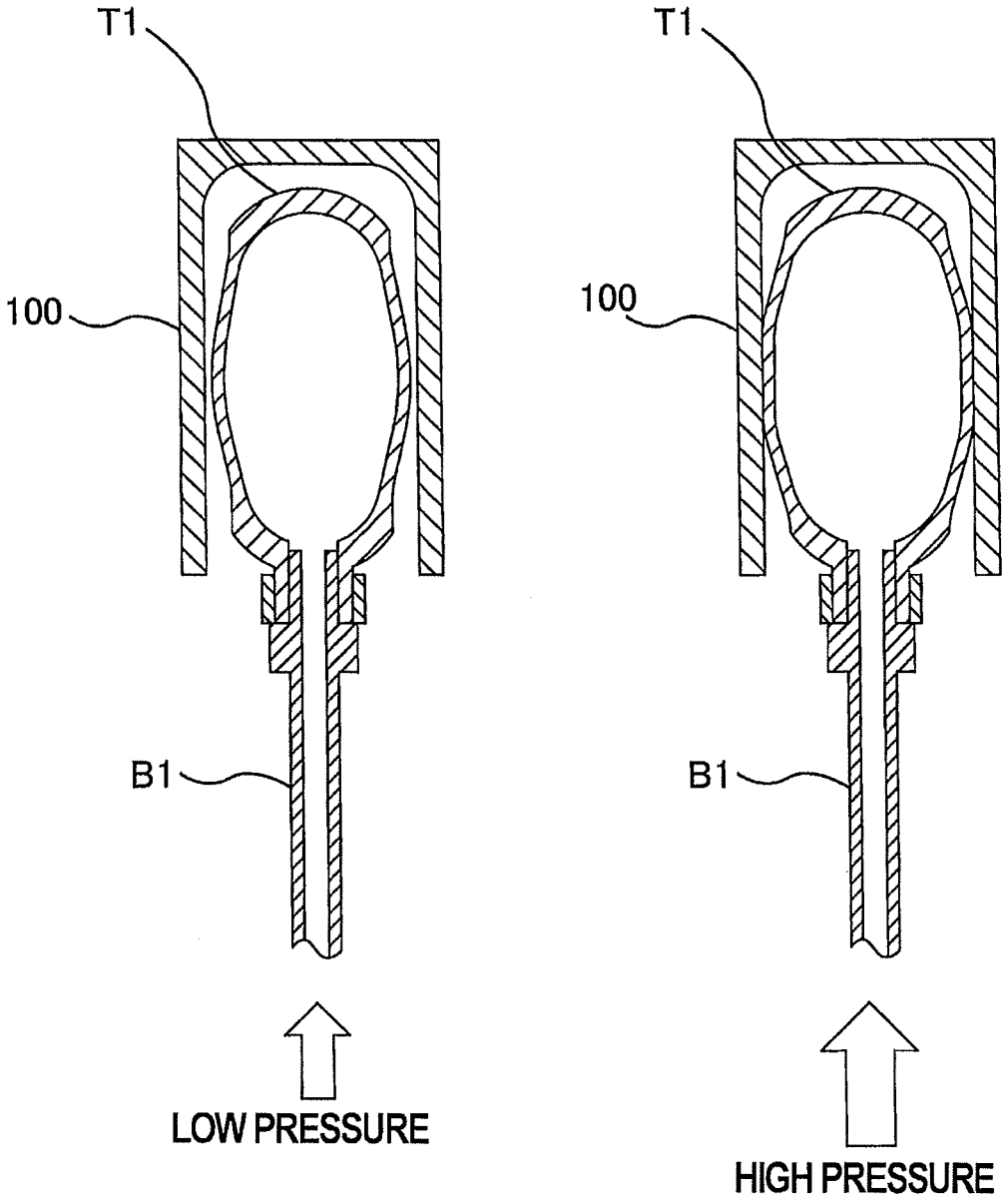
FIG. 30 is a view showing a limiting cover when limiting an expansion of the buffer tank.

FIG. 30 is a view showing the limiting cover 100 when limiting the deformation (expansion) of the buffer tank T1. As shown in FIG. 30, when the pressure in the buffer tank T1 is low, an outer surface of the buffer tank T1 is not in contact with an inner surface of the limiting cover 100. When the pressure in the buffer tank T1 increases to some degree, the outer surface of the buffer tank T1 is brought into contact with the inner surface of the limiting cover 100. As can be seen in FIG. 30, the expansion of the buffer tank T1 is limited by the limiting cover 100, which can therefore prevent the burst of the buffer tank T1.

The thinner a wall of the buffer tank T1, the easier the buffer tank T1 can absorb the fluctuation of the pressure. On the other hand, the thinner the wall of the buffer tank T1, the more the buffer tank T1 is likely to expand during polishing of the wafer and the buffer tank T1 may burst. The limiting cover 100 is capable of remarkably reducing such a risk of the burst of the buffer tank T1. Further, it is possible to regulate a pressure range and the magnitude of the fluctuation of the pressure to be absorbed by the buffer tank T1 through a combination of a shape and a thickness of the buffer tank T1 and a shape and a size of the limiting cover 100.

Figure 31:
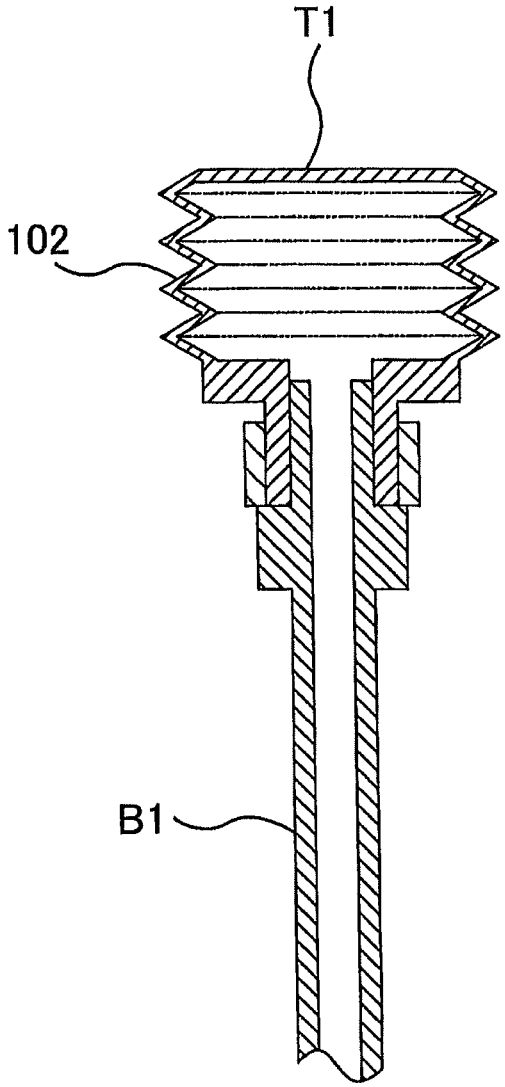
FIG. 31 is a cross-sectional view showing still another example of the buffer tank.

FIG. 31 is a cross-sectional view showing still another example of the buffer tank T1. Other buffer tanks T2 to T6 also have the same structure and the same arrangement as those of the buffer tank T1 shown in FIG. 31. The buffer tank T1 of this example has a circumferential wall that is constructed by a bellows tube 102 formed by resin or metal (for example, stainless steel). The bellows tube 102 is capable of deforming (i.e., expanding and shrinking) in response to the pressure in the buffer tank T1. The bellows tube 102 has an advantage that a thickness of the bellows tube 102 does not change and a mechanical strength thereof is not lowered when the bellows tube 102 expands.

Figure 32:
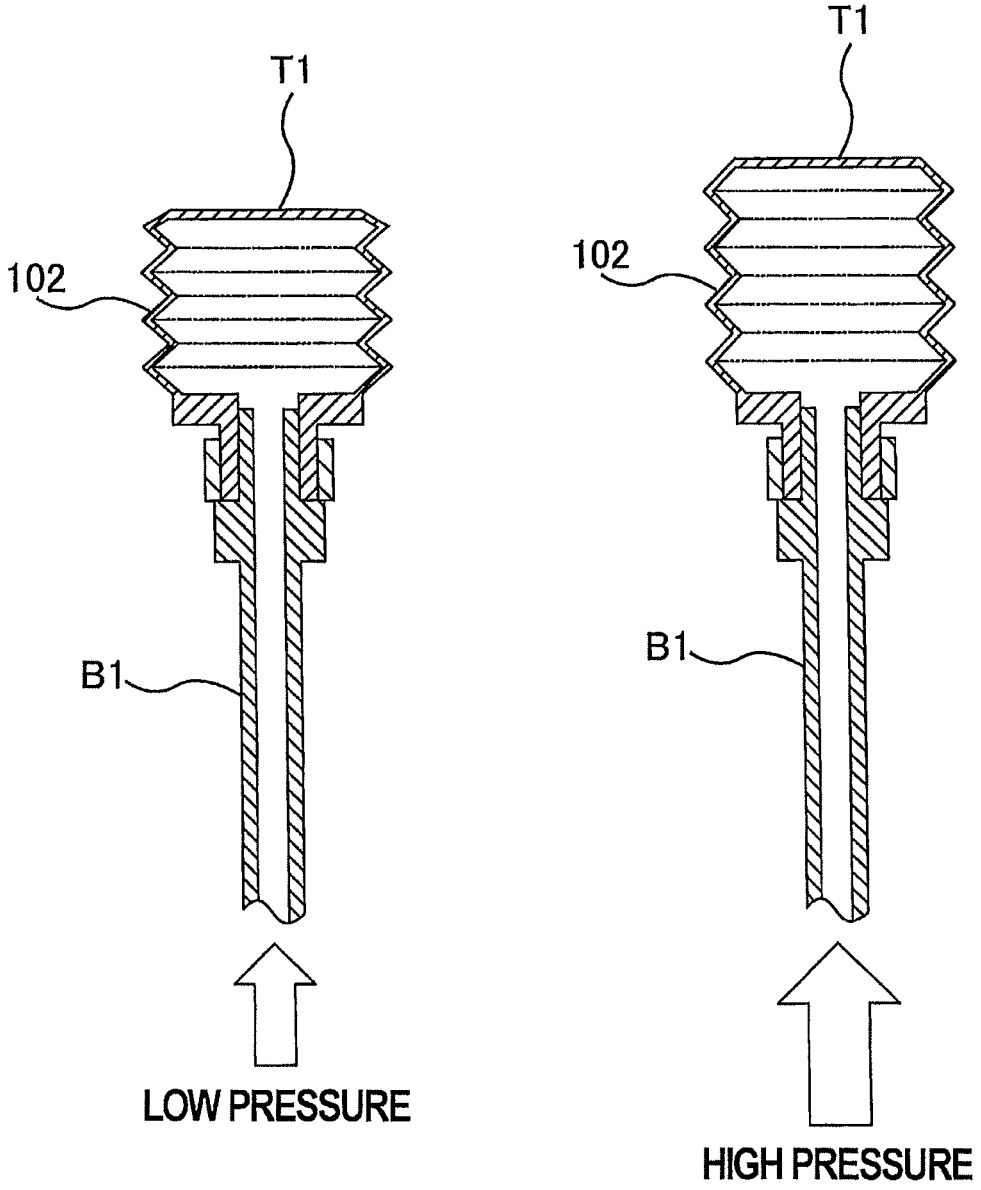
FIG. 32 is a view showing the buffer tank when the pressure therein is low and the buffer tank when the pressure therein is high.

FIG. 32 is a view showing the buffer tank T1 when the pressure therein is low and the buffer tank T1 when the pressure therein is high. As shown in FIG. 32, when the pressure in the buffer tank T1 increases, the bellows tube 102 expands and the volume of the buffer tank T1 increases. In this manner, since the volume of the buffer tank T1 is varied according to the pressure in the buffer tank T1, the buffer tank T1 can absorb the fluctuation of the pressure in the pressure chamber C1 that can occur when polishing of a wafer is performed.

Figure 33:
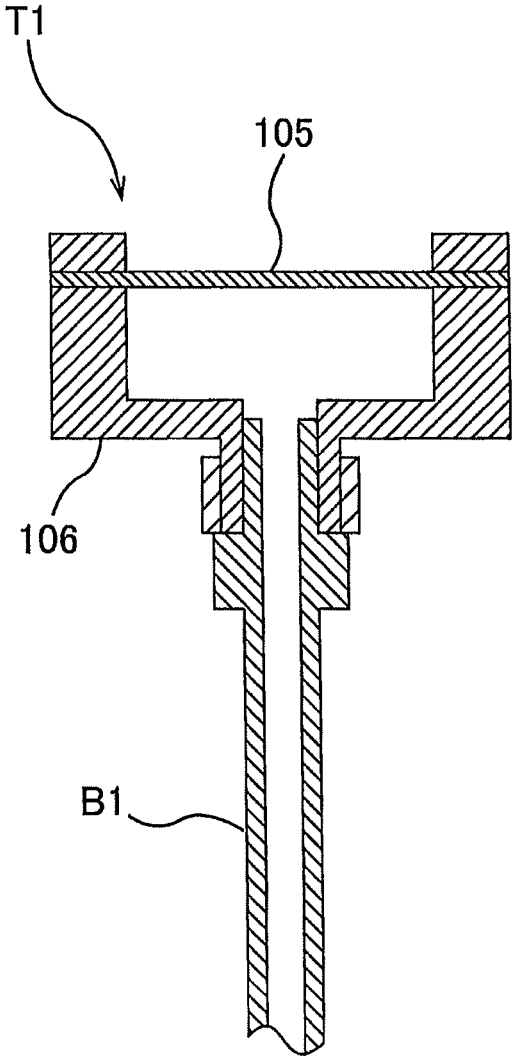
FIG. 33 is a cross-sectional view showing still another example of the buffer tank.

FIG. 33 is a cross-sectional view showing still another example of the buffer tank T1. Other buffer tanks T2 to T6 also have the same structure and the same arrangement as those of the buffer tank T1 shown in FIG. 33. In this example, the buffer tank T1 has a portion that is constructed by a diaphragm 105 which is formed by elastic material, such as resin or rubber. More specifically, the buffer tank T1 includes a container 106 having an opening, and the diaphragm 105 that closes the opening. The diaphragm 105 has a flat shape having no bent portion. The container 106 is formed from a rigid structural member (for example, metal or hard resin). The diaphragm 105 closes the opening of the container 106 to form a hermetic space in the buffer tank T1. This hermetic space is in communication with the branch line B 1.

Figure 34:
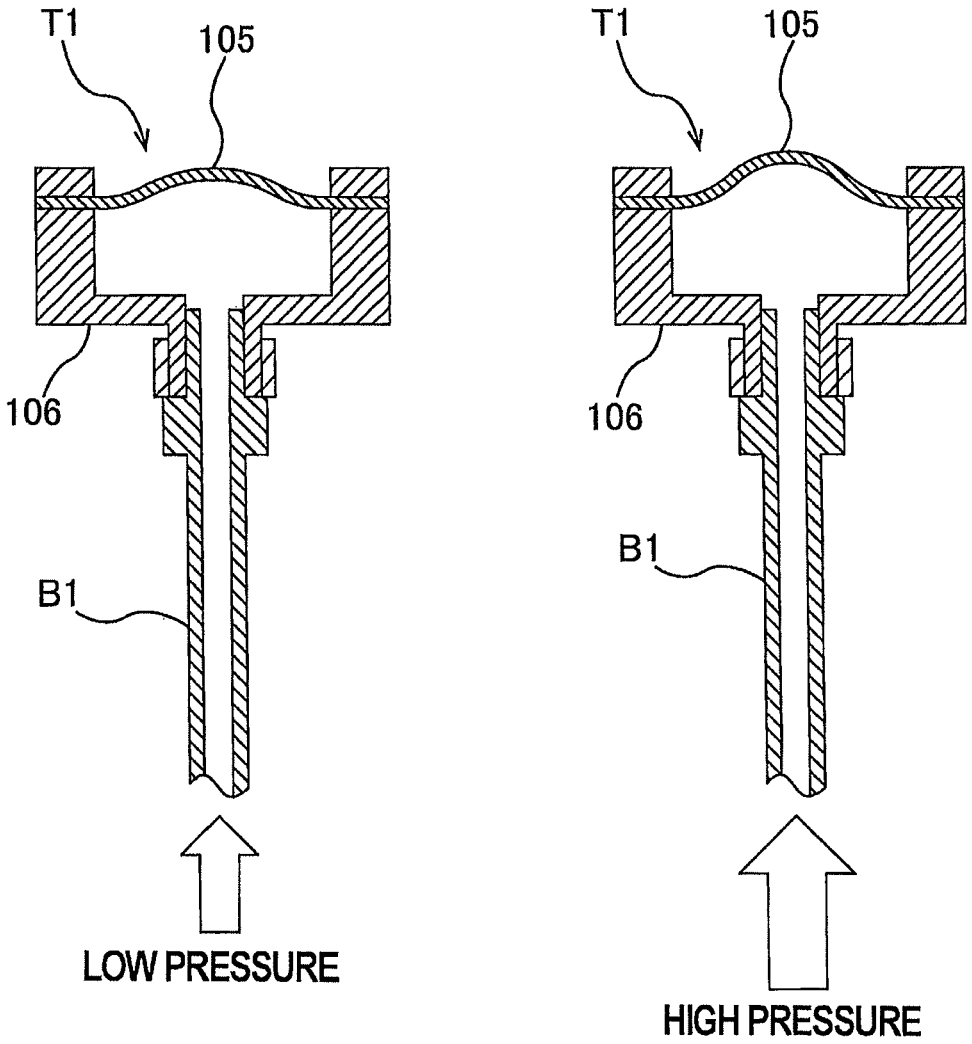
FIG. 34 is a view showing the buffer tank when the pressure therein is low and the buffer tank when the pressure therein is high.

FIG. 34 is a view showing the buffer tank T1 when the pressure therein is low and the buffer tank T1 when the pressure therein is high. As shown in FIG. 34, when the pressure in the buffer tank T1 increases, the diaphragm 105 expands outwardly to increase the volume of the buffer tank T1. In this manner, since the volume of the buffer tank T1 is varied according to the pressure in the buffer tank T1, the buffer tank T1 can absorb the fluctuation of the pressure in the pressure chamber C1 that can occur when polishing of a wafer is performed. The diaphragm 105 is a structural member that is deformable according to the pressure in the buffer tank T1. Since the diaphragm 105 has a simple shape and the deformation thereof is relatively small, the diaphragm 105 is expected to work stably for a long period of time.

Figure 35:
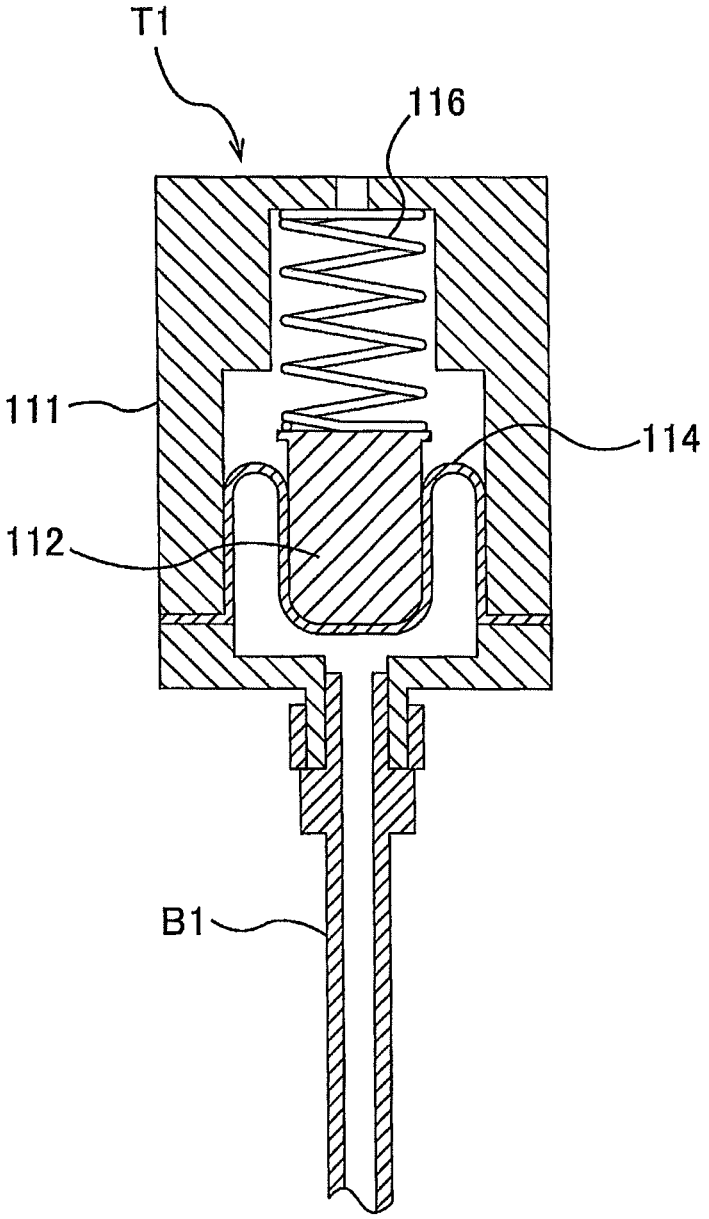
FIG. 35 is a cross-sectional view showing still another example of the buffer tank.

FIG. 35 is a cross-sectional view showing still another example of the buffer tank T1. Other buffer tanks T2 to T6 also have the same structure and the same arrangement as those of the buffer tank T1 shown in FIG. 35. The buffer tank T1 of this example has a cylinder 111 coupled to the branch line B1, a piston 112 disposed in the cylinder 111, a rolling diaphragm 114 sealing a gap between the cylinder 111 and the piston 112, and a spring 116 supporting the piston 112. The rolling diaphragm 114 is formed by elastic member, such as rubber.

The rolling diaphragm 114 has a bent portion having an inverted U-shaped cross section. This bent portion surrounds the piston 112 and seals the gap between the cylinder 111 and the piston 112. A hermetic space is formed in the buffer tank T1 by the rolling diaphragm 114 and an inner surface of the cylinder 111. The hermetic space is in communication with the branch line B 1. The rolling diaphragm 114 is a structural member that is deformable according to the pressure in the buffer tank T1.

Figure 36:
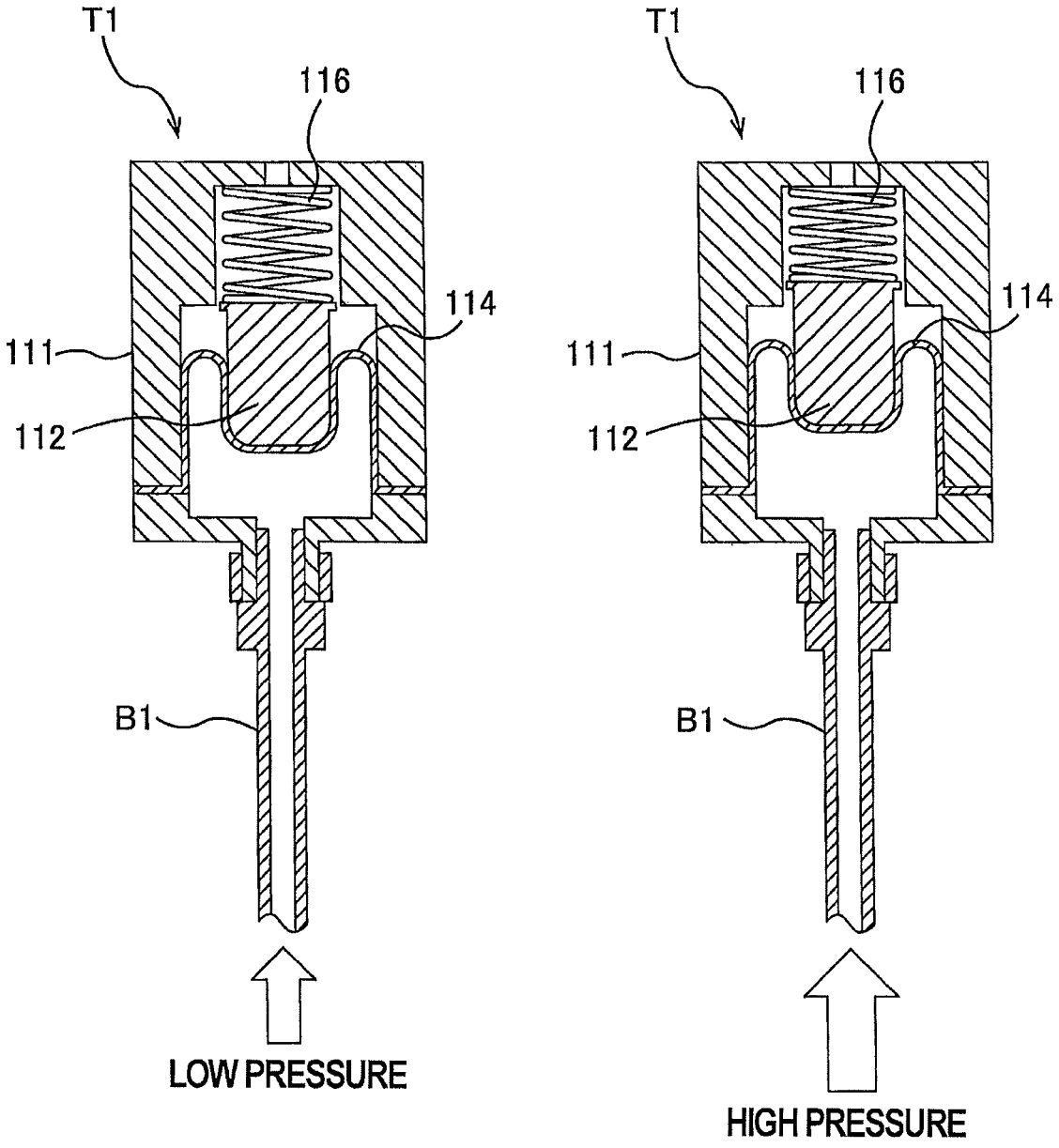
FIG. 36 is a view showing the buffer tank when the pressure therein is low and the buffer tank when the pressure therein is high.

FIG. 36 is a view showing the buffer tank T1 when the pressure therein is low and the buffer tank T1 when the pressure therein is high. As shown in FIG. 36, when the pressure in the buffer tank T1 increases, the piston 112 moves outwardly against a repulsive force of the spring 116. As a result, the volume of the buffer tank T1 increases, while the rolling diaphragm 114 deforms. In this manner, since the volume of the buffer tank T1 is varied according to the pressure in the buffer tank T1, the buffer tank T1 can absorb the fluctuation of the pressure in the pressure chamber C1 that can occur when polishing of a wafer is performed.

The bent portion of the rolling diaphragm 114 is only rolled together with the motion of the piston 112, and the rolling diaphragm 114 is not placed in sliding contact with the piston 112 and the cylinder 111. Therefore, a frictional resistance acting on the rolling diaphragm 114 when the rolling diaphragm 114 is deforming is almost zero. Therefore, the piston 112 can move quickly and smoothly in response to the change in the pressure in the buffer tank T1. Further, since the repulsive force of the spring 116 varies according to the movement of the piston 112, the fluctuation of the pressure can be absorbed in a wide range by increasing a stroke of the piston 112.

The above-described structures shown in FIG. 27 through FIG. 36 may be combined appropriately. For example, the diaphragm 105 shown in FIG. 33 may be incorporated into the buffer tank T1 of air-bag type shown in FIG. 27, so that the buffer tank T1 can absorb the fluctuation of the pressure in a wider range.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a rotatable polishing table for supporting a polishing pad;

a rotatable top ring having a pressure chamber for pressing a substrate against the polishing pad;

a pressure regulator configured to regulate a pressure of a gas in the pressure chamber;

a gas delivery line which couples the pressure regulator to the pressure chamber;

a buffer tank provided between the pressure chamber and the pressure regulator, the buffer tank being a hermetic container having a hermetic space formed therein, a volume of the hermetic space being equal to or larger than a volume of the pressure chamber, the buffer tank being located outside the rotatable top ring; and a branch line which couples the buffer tank to the gas delivery line, the branch line being in communication with the hermetic space of the buffer tank.

2. The polishing apparatus according to claim 1, wherein the pressure regulator includes a pressure-regulating valve, a pressure gauge configured to measure the pressure of the gas at a downstream side of the pressure-regulating valve, and a valve controller configured to control an operation of the pressure-regulating valve so as to minimize a difference between a target value of the pressure in the pressure chamber and a pressure value measured by the pressure gauge.

3. The polishing apparatus according to claim 1, further comprising:

a flow meter configured to measure a flow rate of a gas flowing in the gas delivery line, the buffer tank is located between the pressure regulator and the flow meter.

4. The polishing apparatus according to claim 3, wherein the buffer tank has a structure that does not allow its interior volume to vary regardless of a pressure in the buffer tank.

5. The polishing apparatus according to claim 3, wherein the buffer tank is configured to change its volume according to a pressure in the buffer tank.

6. The polishing apparatus according to claim 5, wherein at least a portion of the buffer tank is formed by a structural member that is deformable according to the pressure in the buffer tank.

7. The polishing apparatus according to claim 6, further comprising:

a limiting cover located outside the buffer tank to limit deformation of the buffer tank.

8. The polishing apparatus according to claim 6, wherein the structural member that is deformable according to the pressure in the buffer tank is a diaphragm.

9. The polishing apparatus according to claim 6, wherein the structural member that is deformable according to the pressure in the buffer tank is a bellows tube.

10. The polishing apparatus according to claim 5, wherein the buffer tank includes:

a cylinder;

a piston disposed in the cylinder;

a rolling diaphragm that seals a gap between the cylinder and the piston; and a spring that supports the piston, the rolling diaphragm has a bent portion surrounding the piston, and the bent portion has an inverted U-shaped cross section.

11. The polishing apparatus according to claim 3, wherein a height of the top ring relative to the polishing pad when the top ring is pressing the substrate against the polishing pad is constant.

12. The polishing apparatus according to claim 1, wherein the buffer tank is configured to change its volume according to a pressure in the buffer tank.

13. The polishing apparatus according to claim 12, wherein at least a portion of the buffer tank is formed by a structural member that is deformable according to the pressure in the buffer tank.

14. The polishing apparatus according to claim 13, further comprising:

a limiting cover located outside the buffer tank to limit deformation of the buffer tank.

15. The polishing apparatus according to claim 13, wherein the structural member that is deformable according to the pressure in the buffer tank is a diaphragm.

16. The polishing apparatus according to claim 13, wherein the structural member that is deformable according to the pressure in the buffer tank is a bellows tube.

17. The polishing apparatus according to claim 12, wherein the buffer tank includes:

a cylinder;

a piston disposed in the cylinder;

a rolling diaphragm that seals a gap between the cylinder and the piston; and a spring that supports the piston, the rolling diaphragm has a bent portion surrounding the piston, and the bent portion has an inverted U-shaped cross section.

18. The polishing apparatus according to claim 12, wherein a height of the top ring relative to the polishing pad when the top ring is pressing the substrate against the polishing pad is constant.

19. A polishing apparatus comprising:

a rotatable polishing table for supporting a polishing pad;

a rotatable top ring having a pressure chamber for pressing a substrate against the polishing pad; and a pressure regulator configured to regulate a pressure of a gas in the pressure chamber, the pressure regulator includes a pressure-regulating valve, a pressure gauge configured to measure the pressure of the gas at a downstream side of the pressure-regulating valve, and a valve controller configured to control an operation of the pressure-regulating valve so as to minimize a difference between a target value of the pressure in the pressure chamber and a pressure value measured by the pressure gauge, the valve controller has an amplification factor of not more than 0 dB when an oscillation frequency of the measured pressure value is within a predetermined frequency range, the amplification factor representing a ratio of the measured pressure value to the target value and being expressed using decibel as unit, and a frequency corresponding to a rotational speed of the polishing table is within the predetermined frequency range.

20. The polishing apparatus according to claim 19, wherein:

the valve controller includes a first valve controller and a second first valve controller;

the pressure regulator has a switching unit configured to switch between the first valve controller and the second valve controller;

the first valve controller has the amplification factor of not more than 0 dB when the oscillation frequency of the measured pressure value is within the predetermined frequency range; and the second valve controller has the amplification factor of more than 0 dB when the oscillation frequency of the measured pressure value is within the predetermined frequency range.

21. The polishing apparatus according to claim 19, wherein the pressure regulator includes a band elimination filter that lowers the amplification factor of the valve controller to 0 dB or less when the oscillation frequency of the measured pressure value is within the predetermined frequency range.

22. The polishing apparatus according to claim 19, wherein the polishing table and the top ring are configured to rotate at a same rotational speed.

23. The polishing apparatus according to claim 19, further comprising:

an amplification factor measuring device configured to measure the amplification factor of the valve controller, the amplification factor measuring device is configured to input a test target value into the pressure regulator while causing the test target value to oscillate at a frequency that is within the predetermined frequency range, obtain an output value of the pressure gauge while inputting the oscillating test target value into the pressure regulator, and calculate the amplification factor of the valve controller from the output value and the test target value.

24. The polishing apparatus according to claim 23, further comprising:

a tuning device configured to adjust an operation of the valve controller to allow the valve controller to have the amplification factor of not more than 0 dB when the calculated amplification factor is more than 0 dB.

* * * * *